US007096815B2

(12) United States Patent
Iino et al.

(10) Patent No.: US 7,096,815 B2
(45) Date of Patent: Aug. 29, 2006

(54) UNDERWATER SCOOTER

(75) Inventors: Keiji Iino, Saitama (JP); Hiroshi Sueshige, Saitama (JP); Masayuki Osumi, Saitama (JP); Yoshihiro Iijima, Saitama (JP); Hiroaki Hasebe, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/102,145

(22) Filed: Apr. 8, 2005

(65) Prior Publication Data

US 2005/0252437 A1 Nov. 17, 2005

(30) Foreign Application Priority Data

Apr. 9, 2004 (JP) ..... 2004-116155
Apr. 9, 2004 (JP) ..... 2004-116157
Apr. 9, 2004 (JP) ..... 2004-116158
Apr. 9, 2004 (JP) ..... 2004-116159

(51) Int. Cl.
*B63C 11/46* (2006.01)

(52) U.S. Cl. ..... 114/315; 114/242

(58) Field of Classification Search ..... 114/315, 114/242, 244
See application file for complete search history.

(56) References Cited

U.S. PATENT DOCUMENTS 2,918,889 A * 12/1959 Rebikoff ..... 114/315
3,084,654 A * 4/1963 Rosenberg et al. ..... 114/315
4,813,367 A * 3/1989 Stevenson ..... 114/315

FOREIGN PATENT DOCUMENTS

JP 01-101294 4/1989

* cited by examiner

*Primary Examiner*—Jesus D. Sotelo
(74) *Attorney, Agent, or Firm*—Carrier, Blackman & Associates, P.C.; Joseph P. Carrier; William D. Blackman

(57) ABSTRACT

An underwater scooter including a main frame on which are disposed two air tanks serving as a saddle area for the operator, a depth adjusting mechanism disposed to the fore of the air tanks, and a steering mechanism disposed to the aft of the air tanks. The depth adjusting mechanism can be swiveled freely around a vertical axis using a swivel mechanism, and moreover the angular displacement in this swiveling is transmitted by a swivel angle displacement transmission mechanism to the steering mechanism so that a rudder swivels around a vertical axis, and thus while the underwater scooter is traveling, the operator can ride upon the main frame and also adjust the depth of travel and direction of forward motion of the underwater scooter by manipulating the depth adjusting mechanism and steering mechanisms. Thus, the burden on the operator is reduced in comparison to that of the conventional types of scooters that tow the operator.

10 Claims, 34 Drawing Sheets

UNDERWATER SCOOTER

The present invention claims priority under 35 USC 119 based on Japanese patent applications JP 2004-11615, JP 2004-116157, JP 2004-116158, and JP 2004-116159, all filed Apr. 9, 2004. The complete disclosure of each of the above-referenced Japanese patent applications is hereby incorporated by reference.

BACKGROUND OF THE INVENTION

1. Field of the Invention

This invention relates to an underwater scooter that can travel on the surface of the water or underwater.

2. Description of the Related Art

Underwater scooters that can travel on the surface of the water or underwater under the control of an operator (diver) have been proposed in the past. This type of underwater scooter typically generates thrust by an internal combustion engine or electrical motor that drives a propeller as the drive power. Moreover, it is provided with grips that are held onto by the operator, in a constitution such that it tows an operator holding onto the grips and assists their forward motion, as taught in Japanese Patent Publication No. Hei 4(1992)-17832, for example.

With underwater scooters according to the prior art, the operator must continue to hold onto the grips during the entire time while being towed by the underwater scooter, so there are drawbacks in that the arms may readily become fatigued and this is a heavy burden. When adjusting the direction of movement or depth of travel, the operator must use the arms to adjust the direction of the underwater scooter, so the burden is particularly heavy at these times.

SUMMARY OF THE INVENTION

Accordingly, one object of the invention is therefore to overcome these problems of the prior art and provide an underwater scooter that lightens the burden on the operator, and particularly lightens the burden accompanying adjustment of the depth of travel and adjustment of the direction of forward motion (turning).

In order to achieve the objects, there is provided in a first aspect of the present invention, an underwater scooter operable to enable a user to travel thereon on a surface of water or underwater, comprising: a main frame having a saddle area on which the operator saddles or is supported; a watertight vessel disposed on the main frame toward a fore end thereof, in a direction of forward motion of the scooter; a drive power unit enclosed within an interior of the watertight vessel; a propeller rotatably disposed on the main frame toward an aft end thereof, in the direction of forward motion of the scooter; a driveshaft passing through an interior of the main frame and adapted for transmitting an output of the drive power to the propeller to turn it; a steering mechanism enabling the scooter to be steered; and a depth adjusting mechanism for enabling the scooter to dive or surface.

In order to achieve the objects, there is provided in a second aspect of the present invention, an underwater scooter operable to enable a user to travel thereon on a surface of water or underwater, comprising: a frame, a left elevator disposed at the left side of the frame and swiveling around a lateral axis; and a right elevator disposed at the right side of the frame and pivotable around the lateral axis; and wherein the left and right elevators are each independently movable to make their swivel angles different up to vertical positions.

In order to achieve the objects, there is provided in a third aspect of the present invention, an underwater scooter operable to enable a user to travel thereon on a surface of water or underwater, comprising: a main frame having a saddle area for supporting an operator thereon; a watertight vessel disposed on the main frame toward a fore end of the scooter; a drive power unit enclosed within an interior of the watertight vessel; a driveshaft passing through an interior portion of the main frame and capable of being rotated by an output of the drive power unit; a propeller rotatably disposed on the main frame toward an aft end of the scooter; a propeller shaft connected to the propeller; a universal joint transmitting an output of the drive shaft to the propeller shaft; and a propeller swivel mechanism for pivotally moving the propeller shaft using the universal joint as a fulcrum, such that the propeller swivels around a vertical axis.

BRIEF DESCRIPTION OF THE DRAWINGS

The above and other objects and advantages of the invention will be more apparent from the following description and drawings, wherein.

DETAILED DESCRIPTION OF THE PREFERRED EMBODIMENTS

Here follows a description of preferred embodiments of the underwater scooter according to the invention made with reference to the appended drawings.

Figure 1:
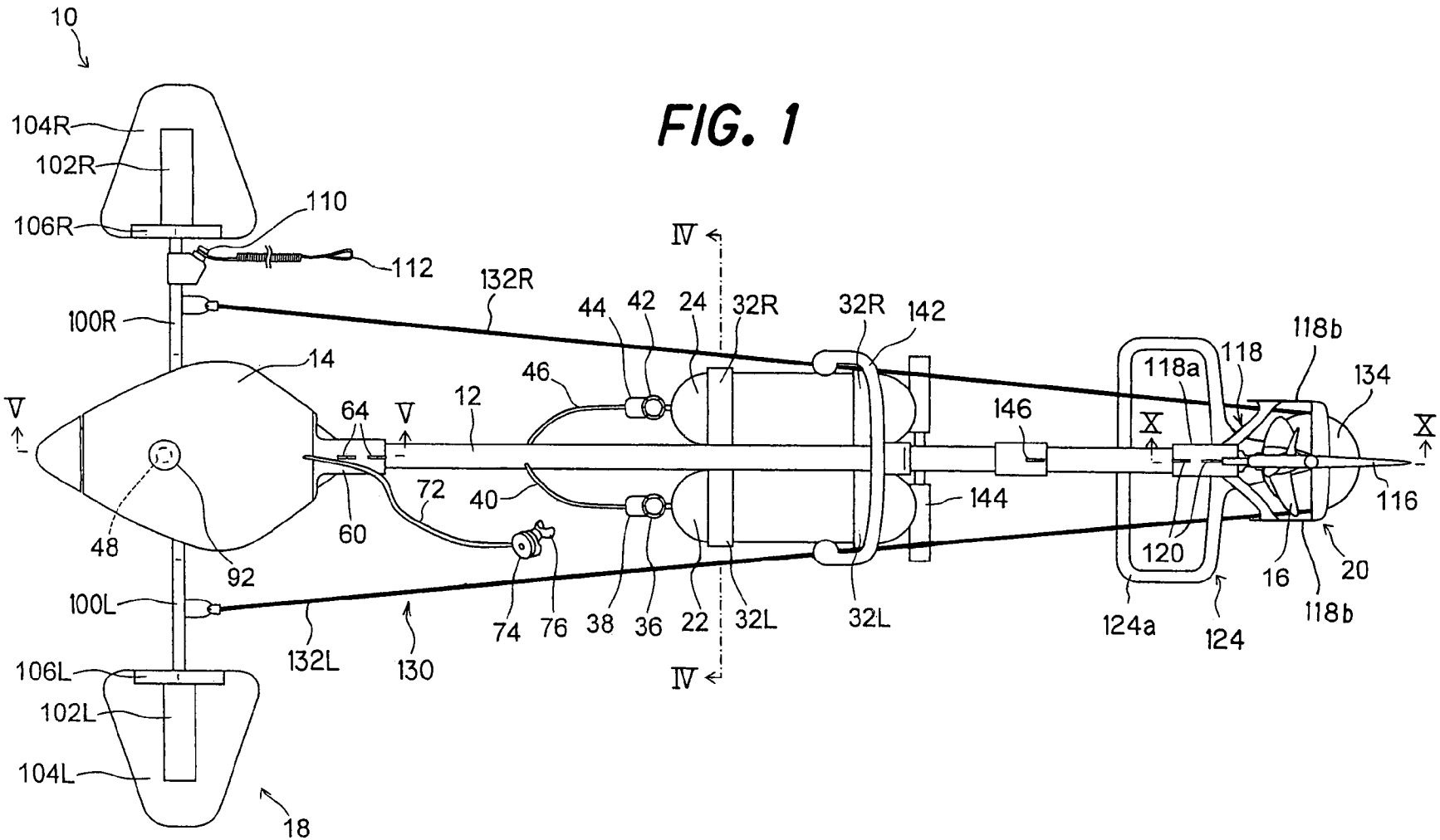
FIG. 1 is a top view of an underwater scooter according to a first embodiment of the invention.

FIG. 1 is a top view of an underwater scooter according to a first embodiment of the invention. In addition, FIG. 2 is a left side view of the underwater scooter shown in FIG. 1, while FIG. 3 is a front view of the underwater scooter shown in FIG. 1.

Figure 2:
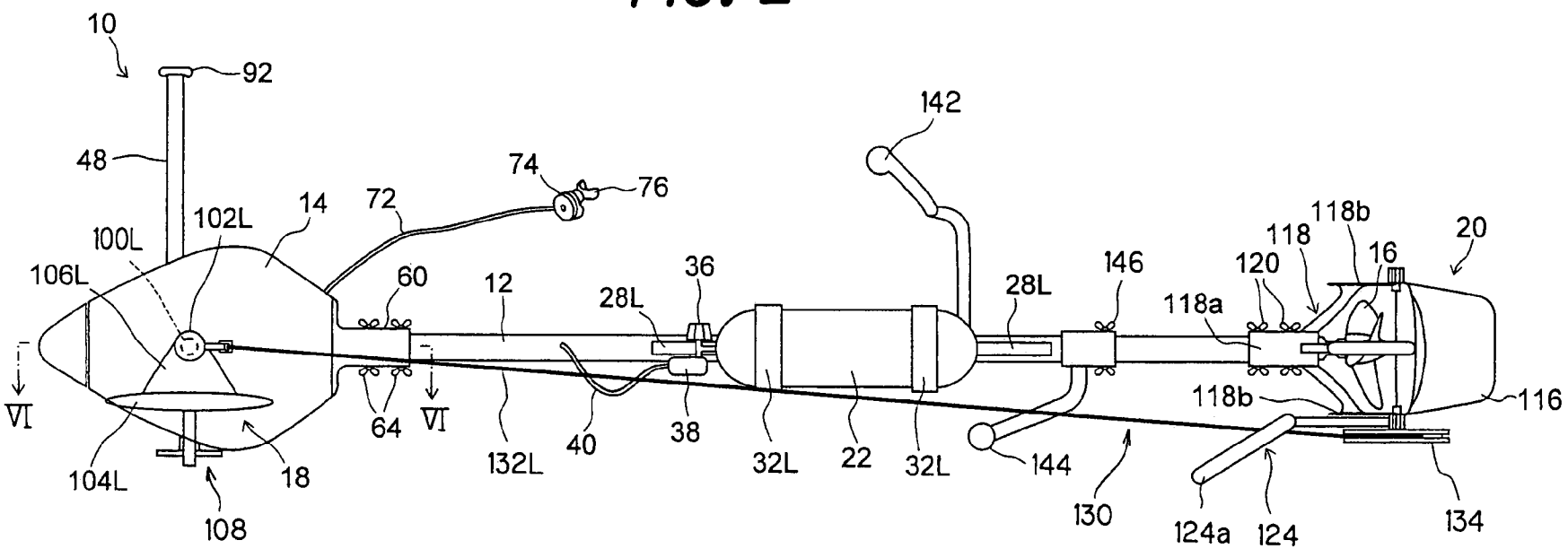
FIG. 2 is a left side view of the underwater scooter shown in FIG. 1.
Figure 3:
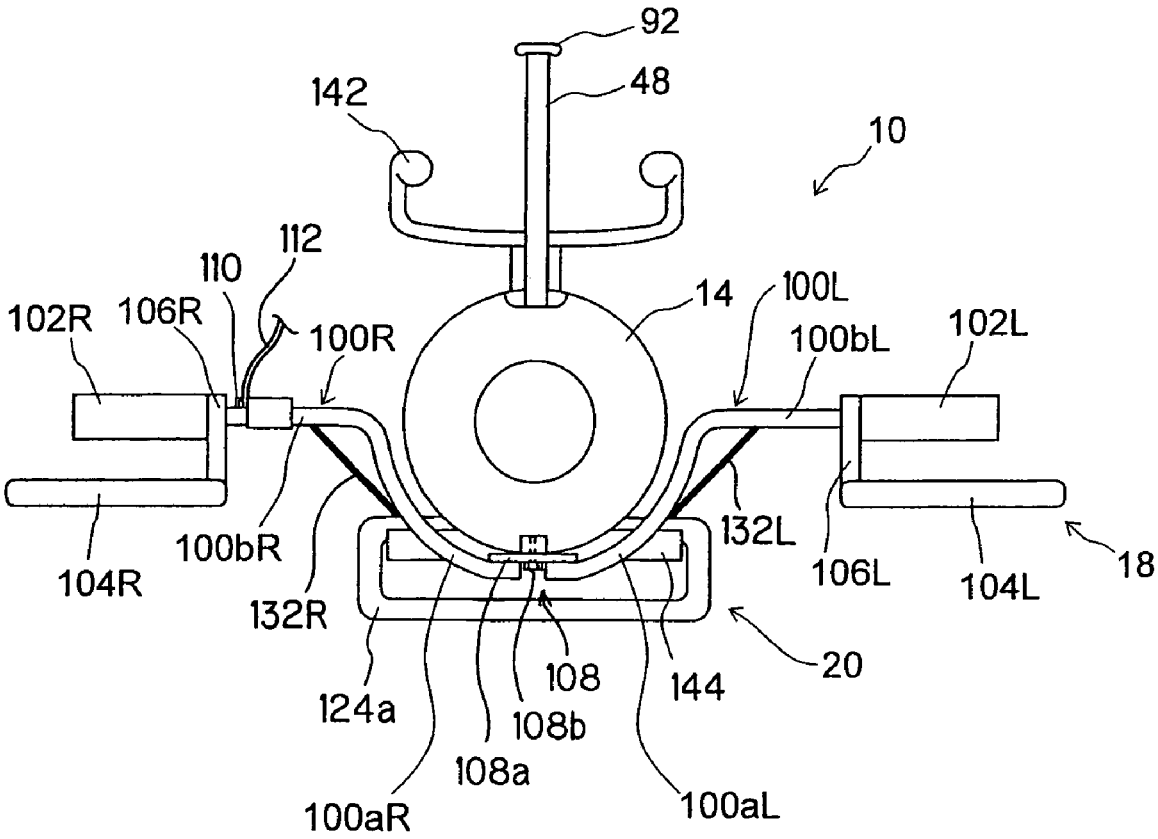
FIG. 3 is a front view of the underwater scooter shown in FIG. 1.

In FIG. 1 through FIG. 3, symbol 10 indicates an underwater scooter. To first describe the general constitution of underwater scooter 10, the underwater scooter 10 comprises: a cylindrical main frame 12 disposed such that its lengthwise direction is parallel to the direction of forward motion of the underwater scooter 10, an ovoid watertight (airtight) vessel 14 disposed upon the main frame 12 toward the fore end thereof in the direction of forward motion, an internal combustion engine (drive power unit or power source; not shown in FIGS. 1–3; hereinafter called the "engine") E enclosed within the interior of the watertight vessel 14, a propeller 16 that is disposed upon the main frame 12 toward the aft end thereof in the direction of forward motion and that is driven and turned by the engine to propel the underwater scooter 10, a drive shaft (not shown in FIGS. 1–3) that passes through the interior of the main frame 12 and that transmits the output of the engine to the propeller 16, a depth adjusting mechanism 18 that is disposed near the watertight vessel 14 and that adjusts the depth of travel of the underwater scooter 10, a steering mechanism 20 that is disposed near the propeller 16 and that adjusts the direction of forward motion of the underwater scooter 10, and a first air tank 22 and second air tank 24 that are disposed upon the main frame 12 between the watertight vessel 14 and propeller 16.

The constituent elements listed above will now be described in detail.

Figure 4:
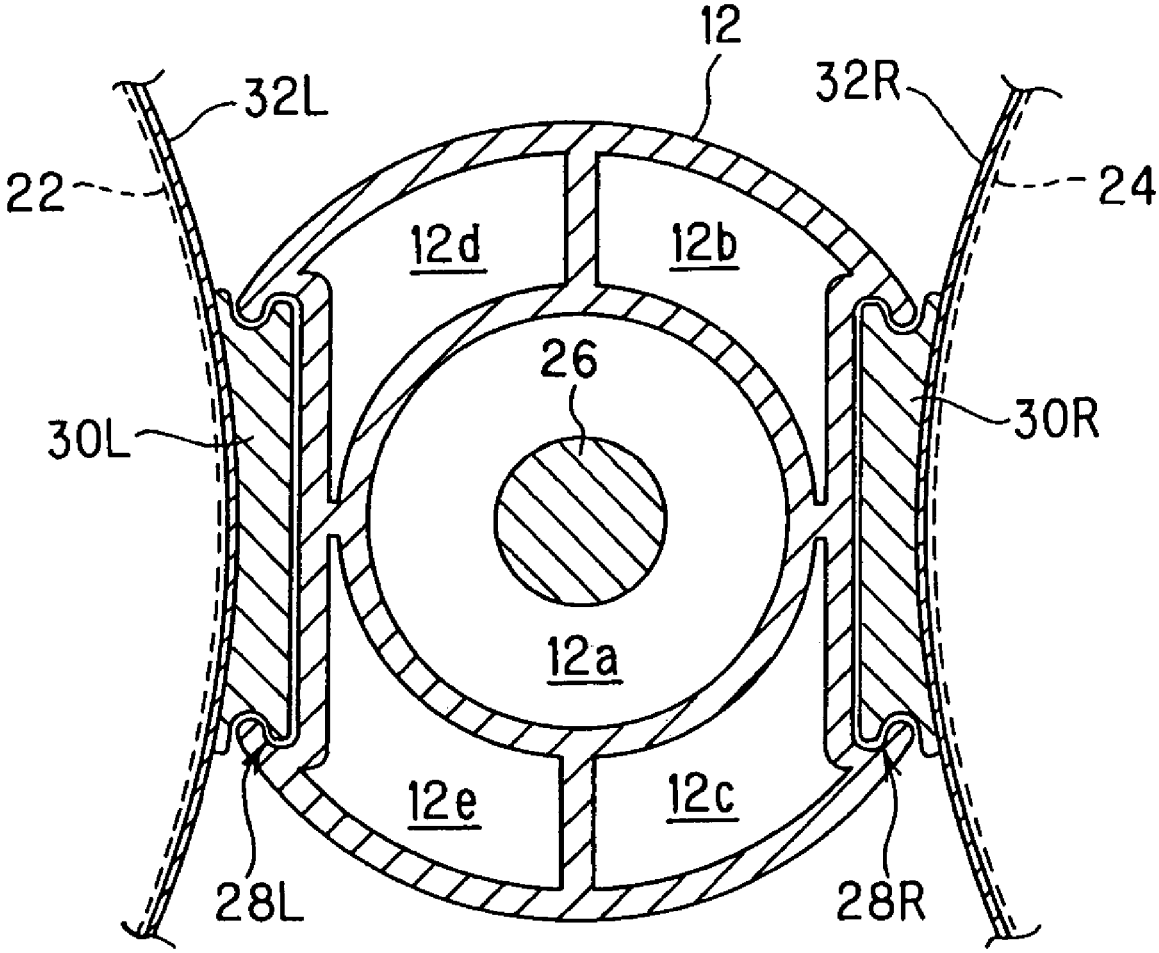
FIG. 4 is an enlarged cross section along the line IV—IV in FIG. 1.

FIG. 4 is an enlarged cross section along the line IV—IV in FIG. 1. As illustrated in the figure, the interior of the main frame 12 is divided by partition walls to form five passages. Each passage is formed as a single contiguous space from the fore end to the aft end of the main frame 12. Among the five passages, the cylindrical first passage 12*a* positioned in the center is the one through which the driveshaft (indicated by the symbol 26) described above passes. In contrast, the second through fifth passages 12*b*, 12*c*, 12*d* and 12*e* formed so as to divide the periphery of the first passage 12*a* serve as paths for the flow of air or exhaust gases as described later.

Grooves 28L and 28R that are substantially C-shaped in cross section (or have the reverse cross section in left-right symmetry) are formed on either side surface of main frame 12. As shown in FIG. 2, groove 28L (and groove 28R positioned on the aft surface) is formed such that it has a stipulated length in the lengthwise direction of main frame 12 (in the direction of forward motion).

Continuing on with the description of FIG. 4, sliders 30L and 30R that are substantially H-shaped in cross section are slidably fitted into the left and right grooves 28L and 28R, respectively. Specifically, the sliders 30L and 30R are constituted so as to be able to slide freely using the protrusions formed at the top edges and bottom edges of the grooves 28L and 28R as rails.

Belts 32L and 32R are provided upon the sliders 30L and 30R, respectively. The first air tank 22 and second air tank 24 described previously are mounted to the sliders 30L and 30R, respectively, by belts 32L and 32R, respectively. Thereby, the first air tank 22 and second air tank 24 are mounted to the main frame 12 such that they are able to slide freely in the lengthwise direction (namely in the direction of forward motion of the underwater scooter 10).

Returning to the description of FIGS. 1–3, the first air tank 22 is connected via a valve 36 to a regulator 38. The regulator 38 is connected via a hose 40 to the interior of the main frame 12 (specifically the second passage 12*b*). On the other hand, the second air tank 24 is connected via a valve 42 to a regulator 44. The regulator 44 is connected via a hose 46 to the interior of the main frame 12 (specifically the third passage 12*c*). Note that the first and second air tanks 22 and 24 may have volumes of roughly 12 liters, for example, and may contain air compressed to high pressure (e.g. roughly 200 atm).

The air contained in the first air tank 22 is depressurized by the regulator 38 to a stipulated pressure (e.g., 10 atm) and then supplied via the hose 40 to the second passage 12*b* in the main frame 12. On the other hand, the air contained in the second air tank 24 is depressurized by the regulator 44 to a stipulated pressure (e.g., 10 atm) and then supplied via the hose 46 to the third passage 12*c* in the main frame 12.

Figure 5:
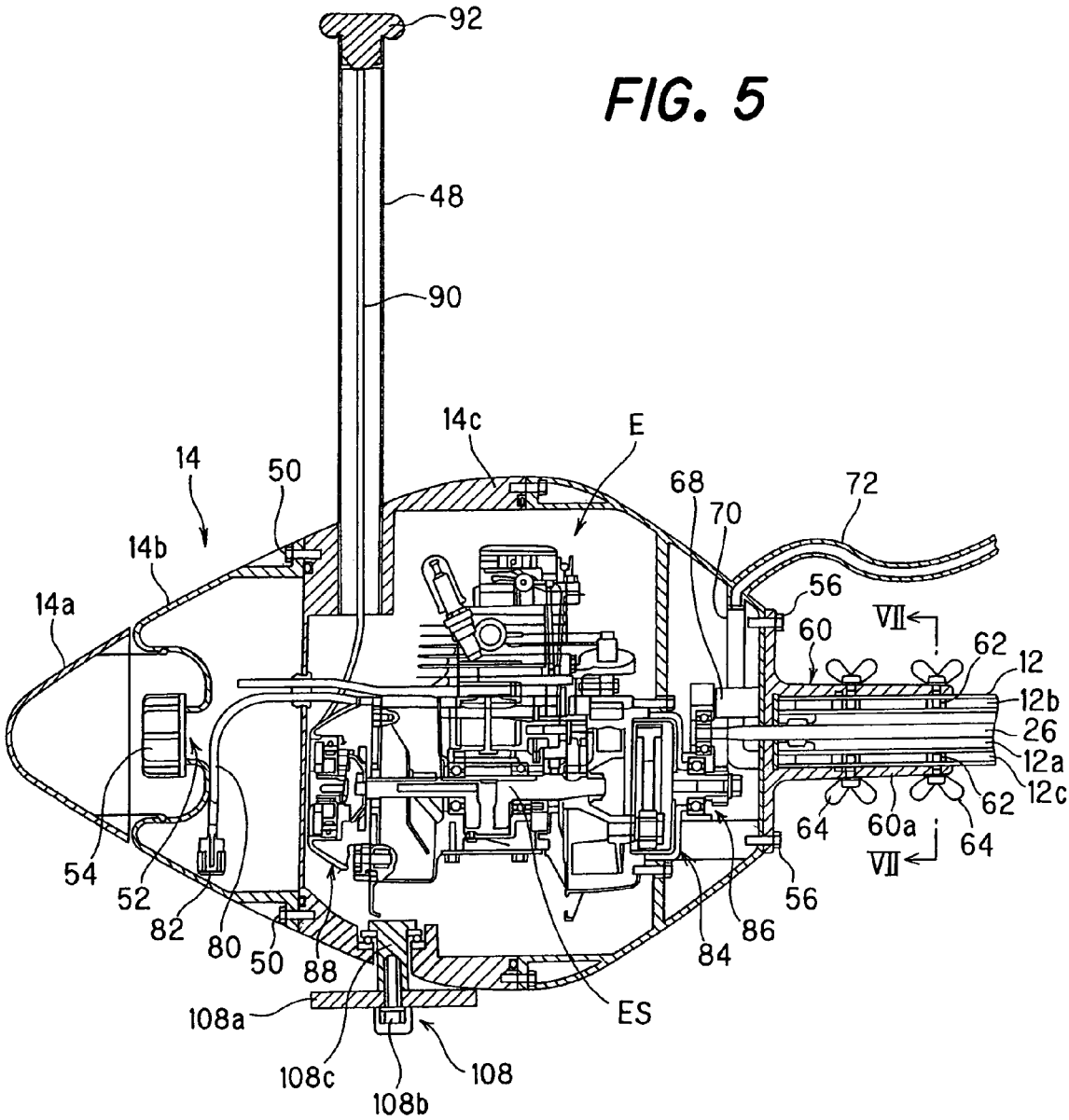
FIG. 5 is an enlarged cross section along the line V—V in FIG. 1.

FIG. 5 is an enlarged cross section along the line V—V in FIG. 1. In addition, FIG. 6 is an enlarged cross section along the line VI—VI in FIG. 2.

Figure 6:
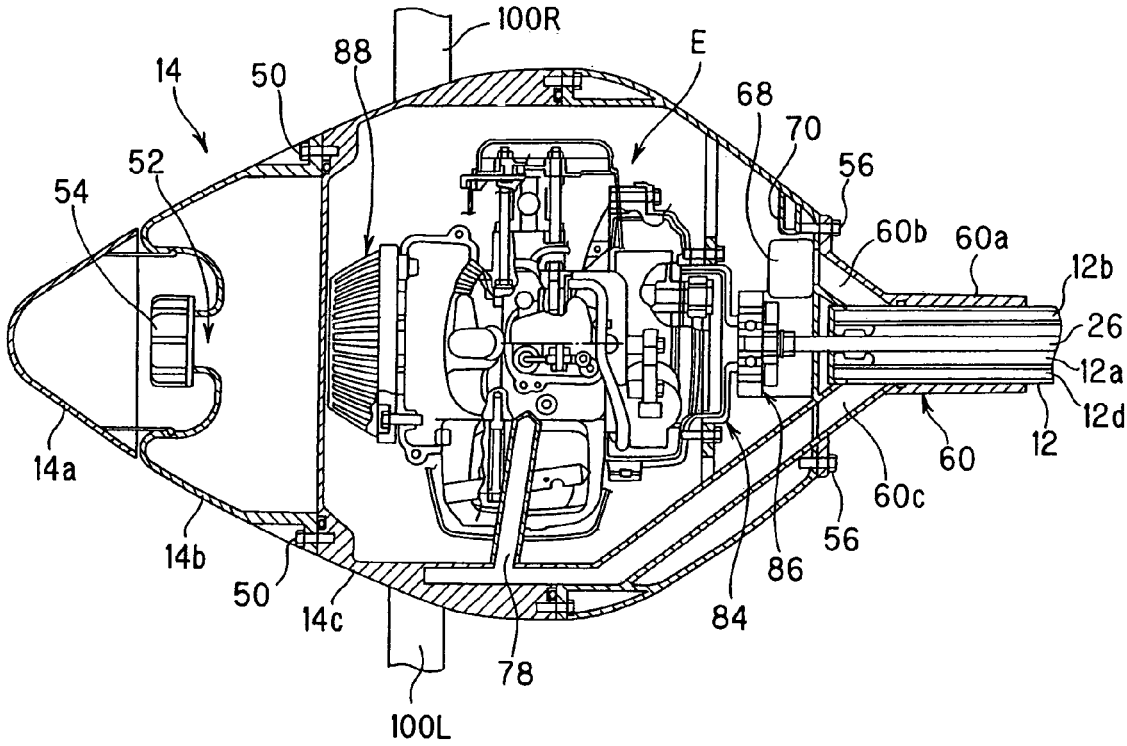
FIG. 6 is an enlarged cross section along the line VI—VI in FIG. 2.

As shown in FIG. 5 and FIG. 6, the watertight vessel 14 comprises three members: a bumper 14*a*, fuel tank 14*b* and an engine enclosure 14*c*, going from fore to aft in the direction of forward motion.

The engine E is enclosed within the engine enclosure 14*c*. The engine E may be a one-cylinder spark-ignition gasoline engine with a displacement of roughly 30 cc, for example. In addition, a snorkel 48 that protrudes upward is provided on top of the engine enclosure 14*c*, and the interior of the engine enclosure 14*c* communicates with the outside (atmosphere) via this snorkel 48.

The fuel tank 14*b* is mounted by bolts 50 to the front of the engine enclosure 14*c*, and the fuel tank 14*b* stores the gasoline fuel to be supplied to the engine E. In addition, a filler neck 52 is provided on a hole in the front surface of the fuel tank 14*b*, and a gas cap 54 seals the filler neck 52.

The bumper 14*a* is attached to the front of the fuel tank 14*b* in order to cover the gas cap 54. The bumper 14*a* is made from a material with a hardness less than that of the other members so as to deform and absorb the impact when the underwater scooter 10 may collide with another object. In addition, the bumper 14*a* is made to be removable without the use of tools in order to simplify filling the fuel tank 14*b* with gasoline fuel.

In addition, a connecting member 60 is mounted by bolts 56 to the aft of the engine enclosure 14*c*. The connecting member 60 is provided with a cylindrical portion 60*a* with an inside diameter roughly equal to the diameter of the main frame 12.

Figure 7:
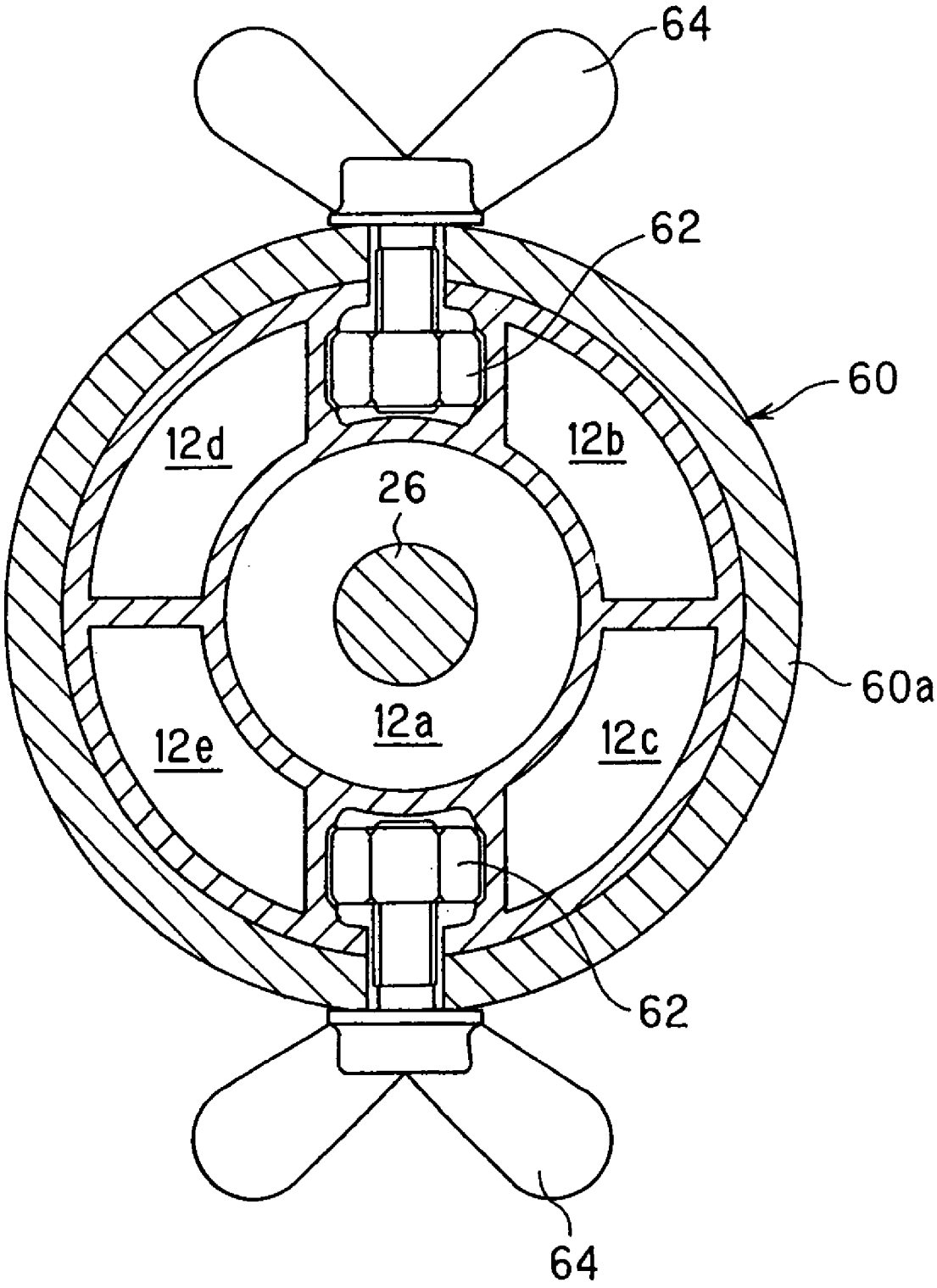
FIG. 7 is an enlarged cross section along the line VII—VII in FIG. 5.

FIG. 7 is an enlarged cross section along the line VII—VII in FIG. 5. As shown in FIG. 7, nuts 62 are enclosed near the tip of the main frame 12. As shown in FIGS. 5-7, the tip of the main frame 12 is inserted into the cylindrical portion 60*a* of the connecting member 60 and wing bolts 64 are screwed into the nuts 62 to mount the watertight vessel 14 to the fore part of the main frame 12 via the connecting member 60. Note that the nuts 62 are surrounded by the partition walls on all sides, and are thus kept from turning.

Returning to the description of FIGS. 5 and 6, the second passage 12*b* of the main frame 12 is connected via a communication passage 60*b* (shown in FIG. 6) formed in the connecting member 60 to a regulator 68 disposed within the watertight vessel 14. In addition, the third passage 12*c* is connected via a communication passage (not shown) formed in the interior of the connecting member 60 and a flow path 70 provided within the watertight vessel 14 to a hose 72 that continues on to the outside of the watertight vessel 14. The end of the hose 72 is connected to a regulator 74 and a mouthpiece 76 is further connected to the regulator 74 (both of which are shown on FIGS. 1 and 2).

The fourth passage 12*d* of the main frame 12 is connected via a communication passage 60*c* formed in the connecting member 60 to an exhaust pipe 78 of the engine E. Note that while this is not shown, a fifth passage 12*e* communicates via a communication passage formed in the connecting member 60 to the interior of the watertight vessel 14.

The engine E is provided with an air intake line (not shown). An air filter is provided near the inlet of the air intake line, and a throttle body (both of which are not shown) is disposed downstream thereof. The throttle body encloses a throttle valve and a carburetor assembly (both of which are not shown) is provided on the upstream side thereof. A fuel pipe or line 80 (shown on FIG. 5) is connected to the carburetor assembly. The fuel pipe 80 communicates with the interior of the fuel tank 14*b* and also its end is connected to a fuel pump 82.

In addition, one end of the crankshaft ES (shown in FIG. 5) of the engine E is connected to a centrifugal clutch 84. The output side of the centrifugal clutch 84 is connected to a reduction gear mechanism 86 and the output side of the reduction gear mechanism 86 is connected to the fore end of the driveshaft 26. Note that the underwater scooter 10 is provided with a throttle unit (not shown) that adjusts the speed of the engine E, and the centrifugal clutch 84 transmits the motive power of the engine E when its speed is increased.

On the other hand, a recoil starter 88 is mounted to the other end of the crankshaft ES. A starter rope 90 for the recoil starter 88 passes through the interior of the snorkel 48 and also a starter grip 92 is provided at its end. The starter grip 92 is constituted such that it can be removably attached to the upper end of the snorkel 48. Specifically, the starter grip 92 is constituted such that it can be inserted into the upper end of the snorkel 48 so that it forms a watertight seal over its opening and also can be freely removed from the upper end. Specifically, when the engine E is to be started, the starter grip 92 is removed from the upper end of the snorkel 48 and the starter rope 90 is pulled. Once the engine E is started, the starter grip 92 is attached to the upper end of the snorkel 48 to seal its opening and prevent water from entering from the snorkel 48.

Figure 8:
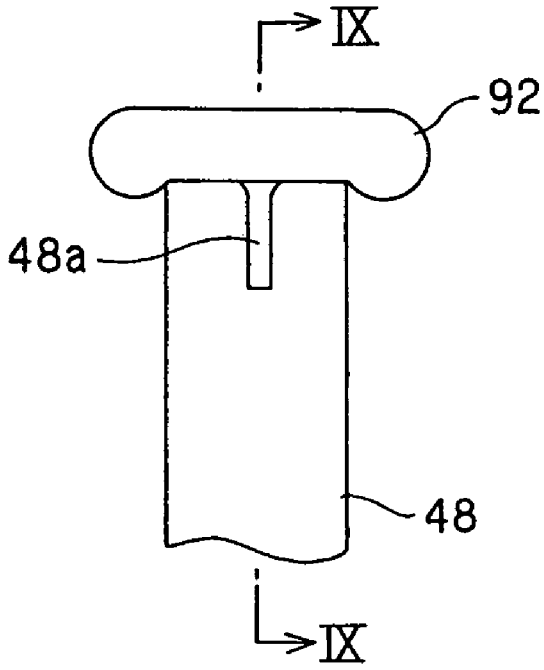
FIG. 8 is an enlargement of the area around the upper end of a snorkel shown in FIG. 2.
Figure 9:
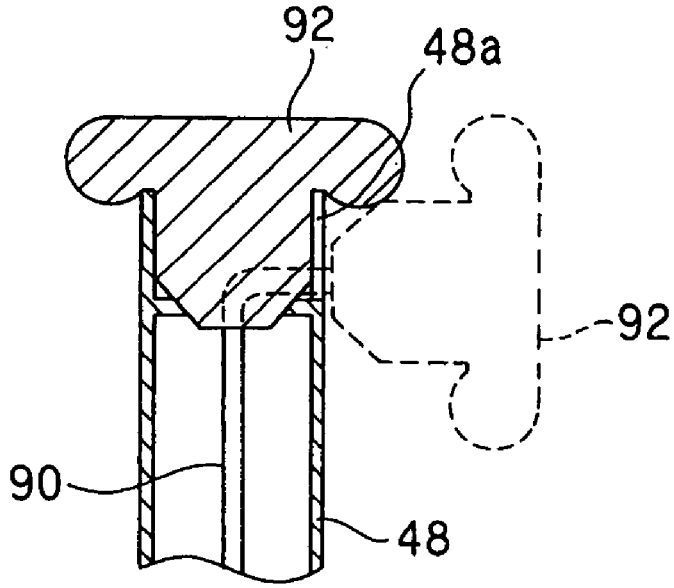
FIG. 9 is a cross section along the line IX—IX in FIG. 8.

FIG. 8 is an enlargement of the area around the upper end of the snorkel 48, while FIG. 9 is a cross section along the line IX—IX in FIG. 8. As shown in FIGS. 8 and 9, a notch 48*a* is provided at the upper end of the snorkel 48 so as to hold the starter grip 92 when removed (as indicated by the broken lines in FIG. 9).

Here, air from the first air tank 22 that is depressurized to a stipulated pressure and supplied to the second passage 12*b* of the main frame 12 is supplied via the communication passage 60*b* to the regulator 68, and also further depressurized by the regulator 68 to the inside pressure of the watertight vessel 14 and then supplied to the interior of the watertight vessel 14 (specifically the engine enclosure 14*c*).

The air supplied to the watertight vessel 14 passes through an air filter and is taken into the air intake line. The carburetor assembly injects gasoline fuel into the air thus taken in to create a fuel-air mixture. The fuel-air mixture thus created is taken into the combustion chamber (not shown) of engine E and is burned. The exhaust gas generated by the combustion of the fuel-air mixture flows via the exhaust pipe 78 and communication passage 60*c* into the fourth passage 12*d* of the main frame 12.

On the other hand, air from the second air tank 24 that is depressurized to a stipulated pressure and supplied to the third passage 12*c* of the main frame 12 is supplied via the communication passage and flow path 70, and further supplied via hose 72 to the regulator 74. The regulator 74 is provided with a diaphragm and other components (not shown) so that, when an operator OP (diver) equipped with a mouthpiece 76 inhales, air depressurized to the pressure of the surrounding water is supplied to the operator.

In this manner, with the underwater scooter 10, the first air tank 22 is attached to the main frame 12 and air within the first air tank 22 is supplied as air for use in combustion by the engine E. In addition, the second air tank 24 is also attached to the main frame 12 and the air within the second air tank 24 is supplied as air for use in breathing by the operator.

Figure 10:
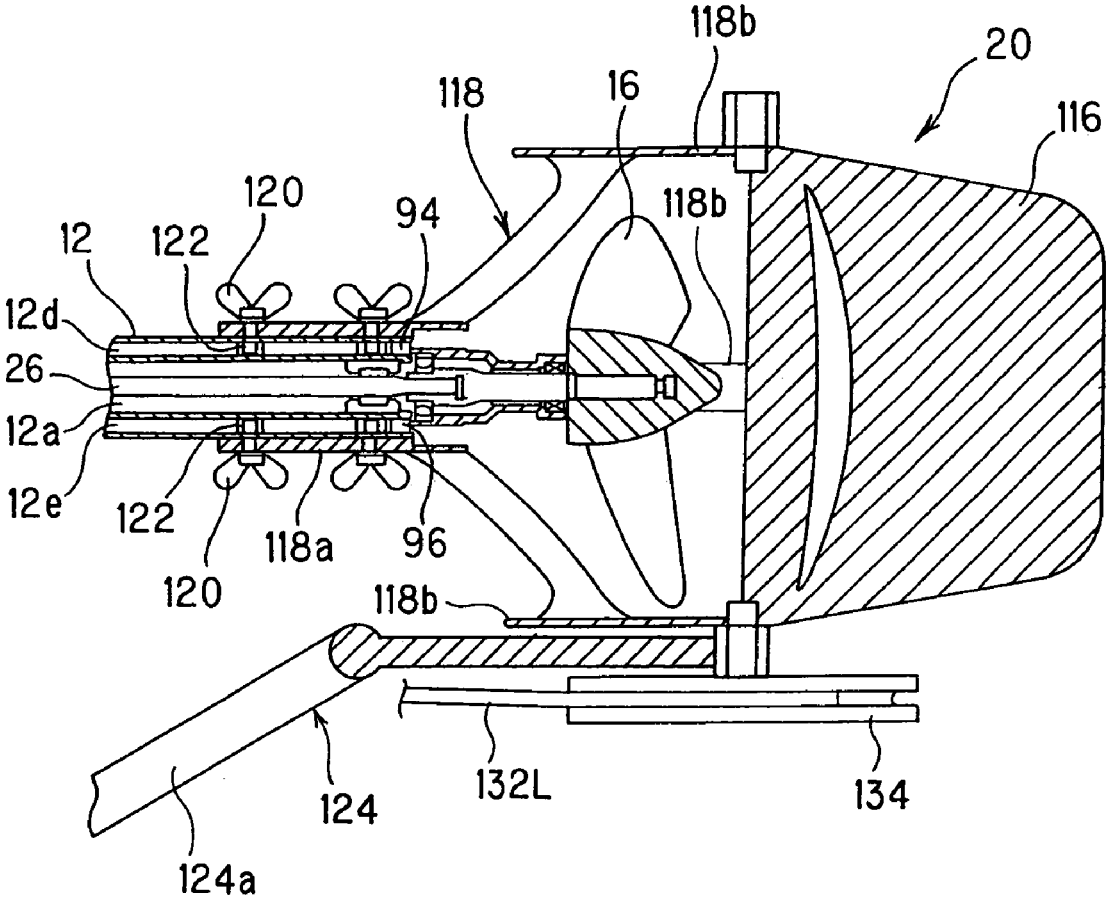
FIG. 10 is an enlarged cross section along the line X—X in FIG. 1.

FIG. 10 is an enlarged cross section along the line X—X in FIG. 1.

As shown in FIG. 10, the propeller 16 is attached to the aft end of the driveshaft 26 passing through the first passage 12*a*. Specifically, the output of the engine E disposed forward of the main frame 12 is transmitted via the aforementioned centrifugal clutch 84, reduction gear mechanism 86 and driveshaft 26 passing through the interior of the main frame 12 to the propeller 16 disposed aft of the main frame 12, and thus the propeller 16 is driven so that the underwater scooter 10 travels over the surface of the water or underwater.

In addition, a first one-way check valve 94 is disposed at the aft end of the fourth passage 12*d* of the main frame 12. The first one-way check valve 94 opens when exhaust gas flows into the fourth passage 12*d* so that its internal pressure exceeds a stipulated pressure, allowing the fourth passage 12*d* to communicate with the outside (underwater). Specifically, exhaust gas from the engine E is exhausted via the exhaust pipe 78, communication passage 60*c*, the fourth passage 12*d* of the main frame 12 and the first one-way check valve 94 to the aft (outside) of the underwater scooter 10.

Moreover, a second one-way check valve 96 is disposed at the aft end of the fifth passage 12*e* of the main frame 12. The second one-way check valve 96 opens when the internal pressure of the fifth passage 12*e* (in other words, the internal pressure of the watertight vessel 14 with which the fifth passage 12*e* communicates) exceeds a stipulated pressure, allowing the fifth passage 12*e* to communicate with the outside (underwater). Specifically, when the internal pressure of the watertight vessel 14 rises due to heat from the engine E or the like, the air within the watertight vessel 14 is exhausted via the communication passage formed in the connecting member 60, the fifth passage 12*e* of the main frame 12 and the second one-way check valve 96 to the aft (outside) of the underwater scooter 10, and thus the internal pressure of the watertight vessel 14 is regulated (depressurized).

As illustrated above, the first passage 12*a* formed in the main frame 12 serves as the passage through which passes the driveshaft 26 serving as the motive power transmission system. In addition, the second passage 12*b* serves as the flow path for air for combustion to be supplied to the engine E, namely becoming the air intake system for the engine E. The third passage 12*c* serves as the flow path for air for breathing to be supplied to the operator, namely becoming the system for supplying air for breathing. Moreover, the fourth passage 12*d* serves as the flow path for exhaust gas exhausted from the engine E, namely becoming the exhaust system for the engine E. The fifth passage 12*e* becomes a communication path for exhausting air within the watertight vessel 14 (the space enclosing the engine E) to the outside, namely becoming the internal pressure regulation system.

Note that while this is not shown, the second passage 12*b* and the third passage 12*c* are sealed at the aft end of the main frame 12. The second passage 12*b* and the third passage 12*c* are sealed at the aft end of the main frame 12 in order to fill the main frame 12 with air from the fore end to the aft end and give uniform buoyancy to the entire main frame 12. The one-way check valves of each of the fourth passage 12*d* and fifth passage 12*e* are disposed at the aft ends of each for the same reason.

Returning to the description of FIGS. 1–3, the depth adjusting mechanism 18 is disposed before a forwardly of the riding-type main frame 12 (before the first and second air tanks 22 and 24 described above).

The depth adjusting mechanism 18 comprises left and right handlebars 100L and 100R, left and right cylindrical grips 102L and 102R, left and right elevators 104L and 104R comprising plates that are substantially trapezoidal in shape when viewed from above, and connector members 106L and 106R that connect the grips 102L and 102R to the elevators 104L and 104R.

To describe the depth adjusting mechanism 18 in detail, as shown in FIG. 3, the left and right handlebars 100L and 100R comprises curved portions 100*a*L and 100*a*R that are curved from below the watertight vessel 14 toward the sides so as to follow the outline thereof, and straight portions 100*b*L and 100*b*R that connect to the curved portions 100*a*L and 100*a*R and also protrude horizontally to the sides of the watertight vessel 14 (in a direction lateral to the underwater scooter 10).

Figure 11:
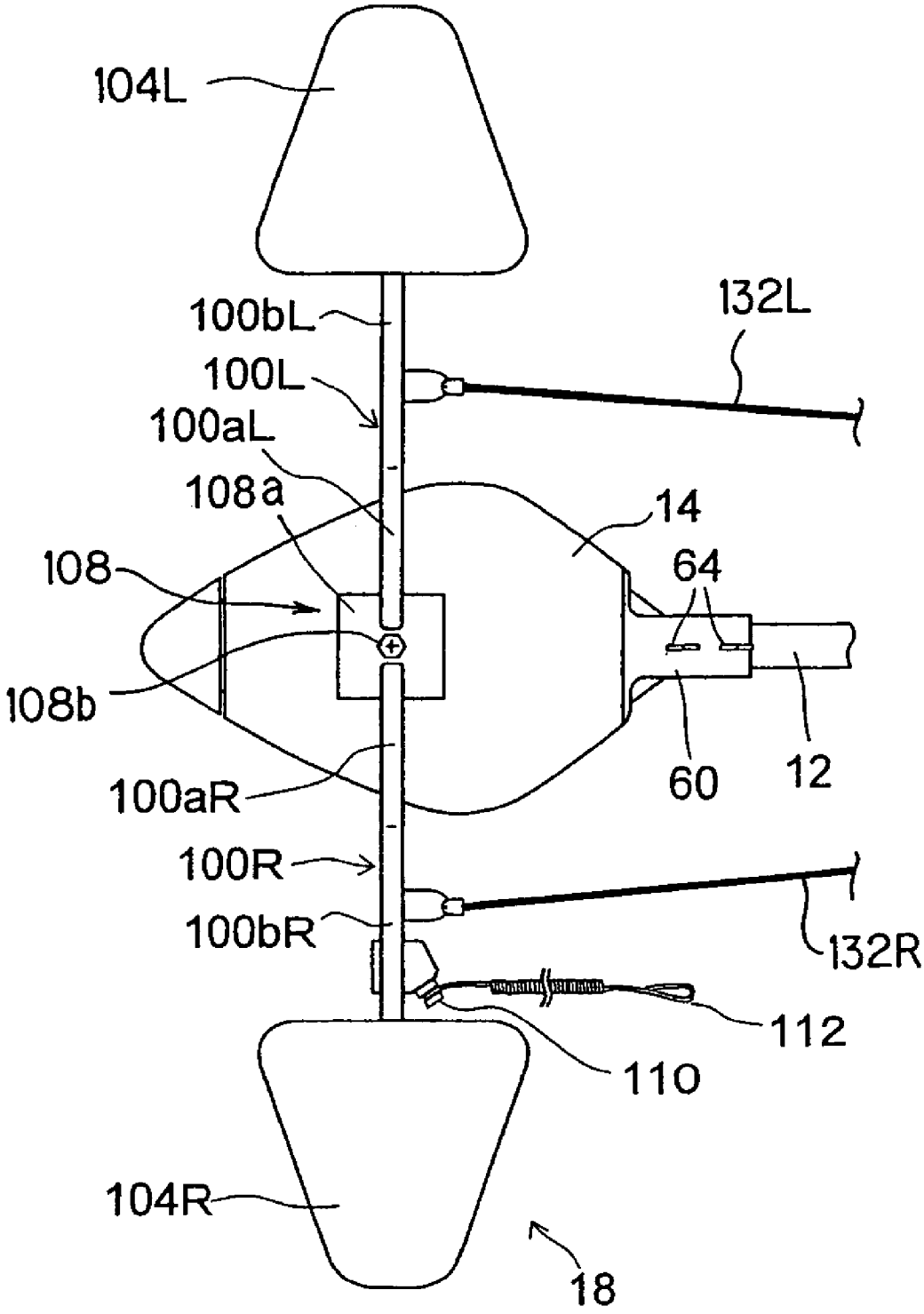
FIG. 11 is a bottom view of a watertight vessel shown in FIG. 1.

FIG. 11 is a bottom view of the watertight vessel 14.

As shown in FIG. 3 and FIG. 11, one end of each of the left and right handlebars 100L and 100R (the ends on the side of the curved portions 100*a*L and 100*a*R) is attached to the watertight vessel 14 via a swivel mechanism 108. The swivel mechanism 108 comprises a plate 108*a* to which one end of each of the left and right handlebars 100L and 100R is attached, a rotating pin (to be described later) that is able to rotate around a vertical axis and a bolt 108*b* that secures the plate 108*a* to the rotating pin.

As shown in FIG. 5, the rotating pin (indicated by the symbol 108*c*) described above is provided on the bottom of the watertight vessel 14, with the plate 108*a* attached to its lower end by the bolt 108*b*. Thereby, the left and right handlebars 100L and 100R are able to swivel freely around a vertical axis centered upon one end of each.

In addition, as shown in FIGS. 1–3, the left and right grips 102L and 102R are attached to the other ends of the left and right handlebars 100L and 100R (the ends on the side of the straight portions 100*b*L and 100*b*R). Note that the left and right grips 102L and 102R are attached so that they are able to turn (specifically, rotate) freely around the left and right handlebars 100L and 100R, respectively, as the center of rotation.

The elevators 104L and 104R are connected to the left and right grips 102L and 102R, via the respective connector members 106L and 106R. Thereby, the elevators 104L and 104R are disposed on either side of the watertight vessel 14 and able to swivel freely around a lateral axis with respect to the underwater scooter 10. Specifically, by rotating the grips 102L and 102R, it is possible to vary the magnitude of inclination and orientation of the elevators 104L and 104R disposed on either side of the watertight vessel 14 around a lateral axis with respect to the underwater scooter 10, and thus adjust the buoyancy (forces that causes the underwater scooter 10 to dive or surface) acting on the elevators 104L and 104R.

In addition, an emergency switch 110 is provided at an appropriate position on the right-side handlebar 100R. One end of an emergency cord 112 (shown in FIG. 1 and FIG. 3) that serves as an on/off trigger is attached to the emergency switch 110. The other end of the emergency cord 112 is attached to the wrist of the operator as described later.

To continue the description of FIGS. 1–3, the steering mechanism 20 is disposed to the aft of the main frame 12 (aft of the first and second air tanks 22 and 24). The steering mechanism 20 comprises a rudder 116 and a connecting member 118 that connects the rudder 116 to the aft end of the main frame 12.

To describe the steering mechanism 20 in detail, the connecting member 118 is provided with a cylindrical portion 118*a* with an inside diameter roughly equal to the diameter of the main frame 12. As shown in FIG. 10, the aft end of the main frame 12 is inserted into the cylindrical portion 118*a* of the connecting member 118 and wing bolts 120 are screwed into nuts 122 enclosed in the interior of the main frame 12 to mount the connecting member 118, or in other words, the steering mechanism 20 to the main frame 12. Note that while this is not shown, the nuts 122 like the aforementioned nuts 62 are surrounded by the partition walls on all sides, and are thus kept from turning.

The connecting member 118 is provided with a total of four vanes 118*b* (top, bottom, left and right) connected to the aforementioned cylindrical portion 118*a*. The vanes 118*b* are formed so as to avoid contact with the propeller 16 in either the vertical direction or the lateral direction and also their aft ends are positioned further aft of the propeller 16. The aforementioned rudder 116 is supported such that it is able to swivel freely around a vertical axis at the aft ends of the two of the vanes 118*b* disposed at the top and bottom. Note that the symbol 124 in the figures indicates a foot stand 124 on which the feet of the operator are to be placed.

Here, as shown in FIGS. 1–3, the depth adjusting mechanism 18 and steering mechanism 20 are mechanically connected via a swivel angle displacement transmission mechanism 130. The swivel angle displacement transmission mechanism 130 comprises two wires 132L and 132R and a steering wheel 134.

To describe the swivel angle displacement transmission mechanism 130 in detail below, the steering wheel 134 is attached to the bottom edge of the rudder 116.

In addition, the wire 132L disposed on the left side when looking in the direction of forward motion has one end connected to the left-side handlebar 100L of the depth adjusting mechanism 18 and the other end connected to the steering wheel 134. Similarly, the wire 132R disposed on the right side when looking in the direction of forward motion has one end connected to the right-side handlebar 100R of the depth adjusting mechanism 18 and the other end connected to the steering wheel 134.

Figure 12:
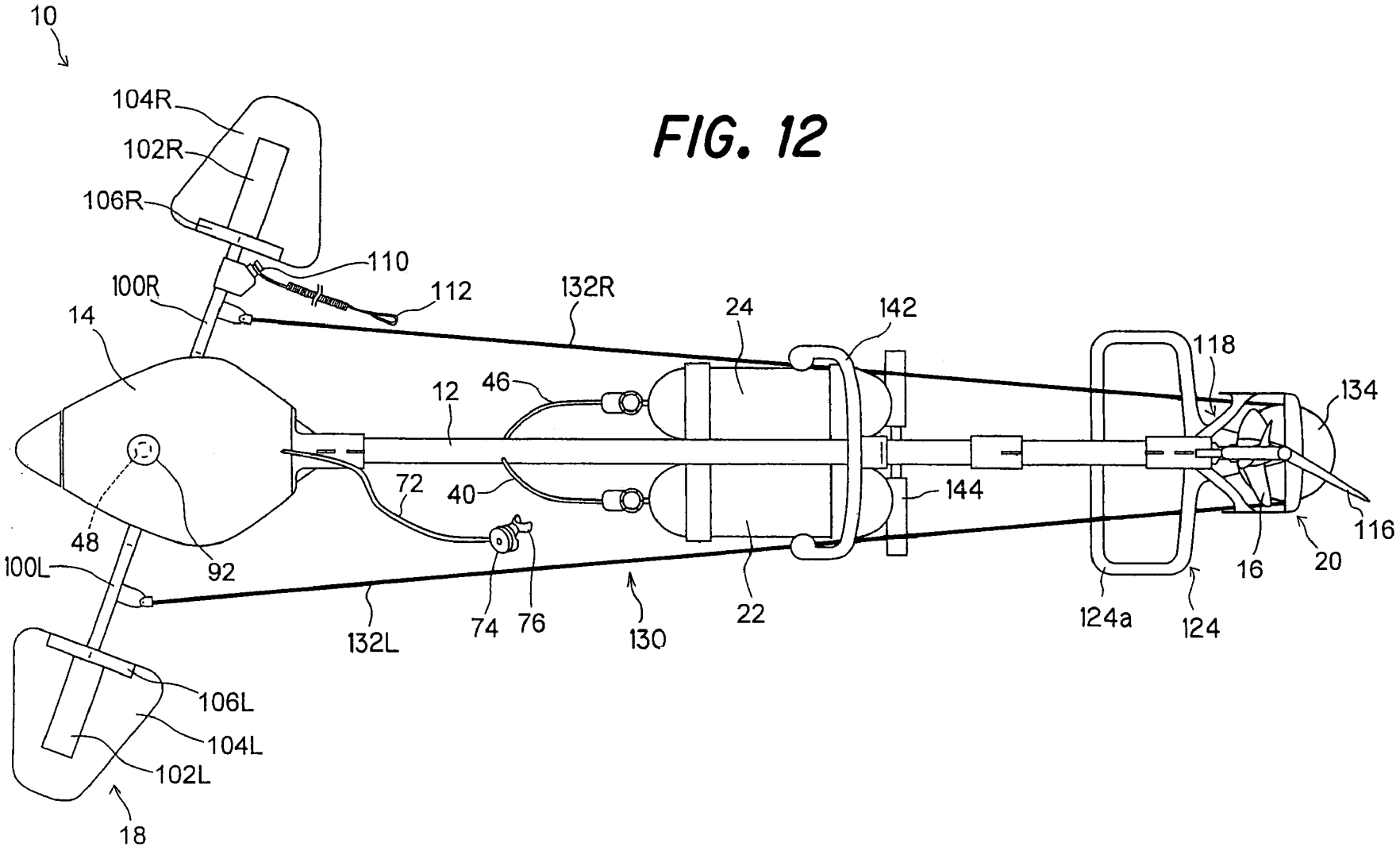
FIG. 12 is a top view of the underwater scooter and illustrating the operation of a swivel angle displacement transmission mechanism shown in FIG. 1.
Figure 13:
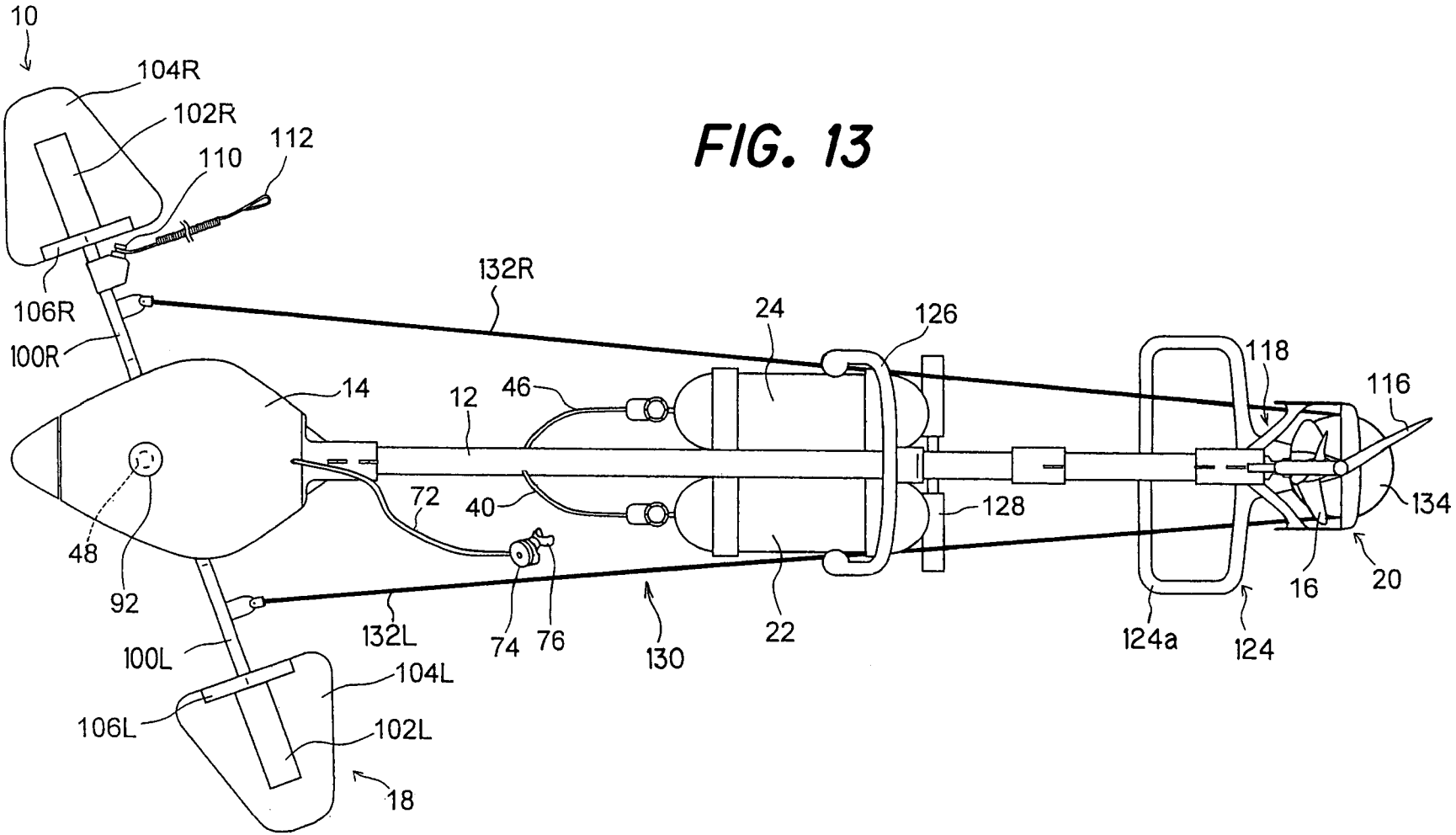
FIG. 13 is a top view of the underwater scooter and also illustrating the operation of the swivel angle displacement transmission mechanism shown in FIG. 1.

Thereby, angular displacement in the swiveling of the depth adjusting mechanism 18 around the vertical axis is transmitted to the steering mechanism 20. Specifically, as shown in FIG. 12 and FIG. 13, by swiveling the left and right handlebars 100L and 100R around the vertical axis, the steering wheel 134 is turned via the wires 132L and 132R, thus causing the rudder 116 to swivel. Note that the wires 132L and 132R are connected on the depth adjusting mechanism 18 side to portions of the respective handlebars 100L and 100R that do not swivel around the lateral axis, so even if the elevators 104L and 104R are swiveled around the lateral axis, the angular displacement in this swiveling is not transmitted to the rudder 116.

Figure 14:
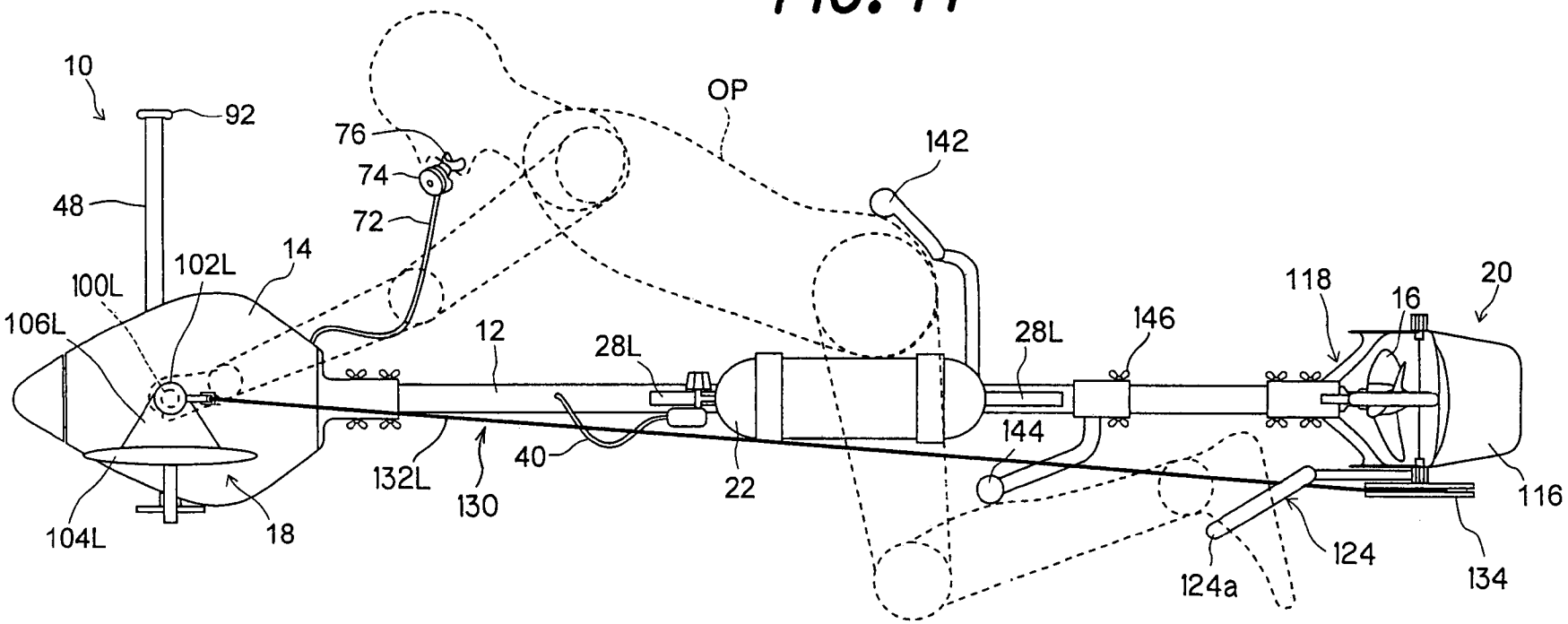
FIG. 14 is a left-side view of the underwater scooter, with an operator riding thereon, shown in FIG. 1.

FIG. 14 is a left-side view of the underwater scooter 10 and the operator riding it.

As shown in FIG. 14, the operator OP rides above the first air tank 22 and the second air tank 24. Specifically, the operator OP is seated or supported upon the first air tank 22 and the second air tank 24 so as to straddle the main frame 12. Taking a forward-inclined posture, the operator holds onto the fore-positioned left and right grips 102L and 102R and also places their feet upon the aft-positioned footrest 124*a* of the foot stand 124, or specifically, rests the backs of their feet there. Note that the footrest 124*a* is annular in shape in a top view, as shown on FIG. 1.

At this time, the waist of the operator OP is supported by a waist holder 142 attached to the sliders 30L and 30R described previously. In addition, the backs of the knees of the operator OP are supported by a leg rest 144 attached to the main frame 12. Note that like the aforementioned connecting member 60 and the like, the leg rest 144 is attached by screwing wing bolts 146 into nuts (not shown) that are enclosed within the interior of the main frame 12, and are thus kept from turning.

In addition, one end of the aforementioned emergency cord 112 (omitted from FIG. 14) is worn on the wrist of the operator OP. Thereby, should the operator OP fall off of the underwater scooter 10, the other end of the emergency cord 112 will be pulled out of the emergency switch 110, and an emergency shutdown signal is sent to shut down the engine E.

Here follows a description of how the operator OP operates the underwater scooter 10, or specifically how the depth of travel and direction of motion are adjusted.

Figure 15:
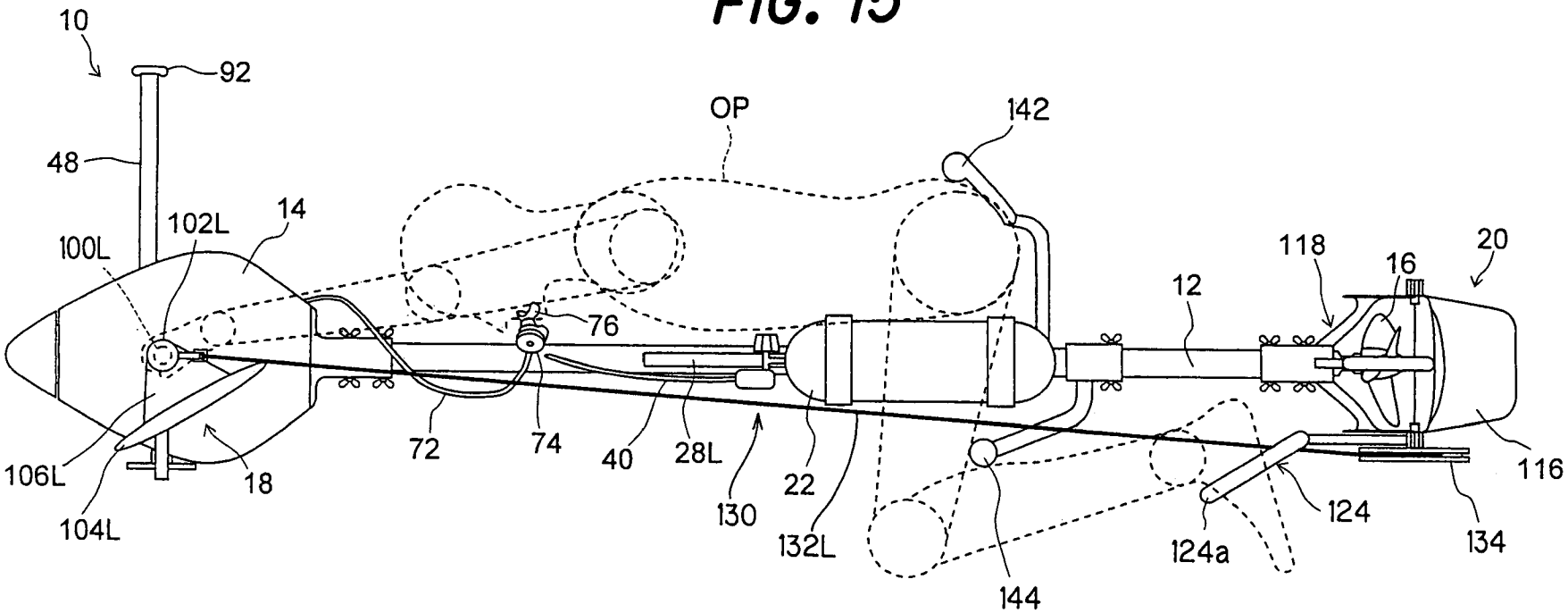
FIG. 15 is also a left-side view of the underwater scooter, with the operator riding thereon, shown in FIG. 1.

First, to make the underwater scooter 10 dive, as shown in FIG. 15, the left and right grips 102L and 102R are rotated so that the left and right elevators 104L and 104R are positioned with their fore edges below their aft edges. When the underwater scooter 10 moves forward in this state, a downward force acts on the left and right elevators 104L and 104R, causing the underwater scooter 10 to dive. In addition, at this time, the operator OP slides the first and second air tanks 22 and 24 serving as the saddle area toward the aft. Namely, the position at which the buoyancy of the first and second air tanks 22 and 24 acts is shifted toward the aft. Thereby, the buoyancy of the aft part of the underwater scooter 10 becomes greater and the fore part of the underwater scooter 10 sinks down (the aft part floats up), thus assuming a posture suited to diving (making diving easier).

Figure 16:
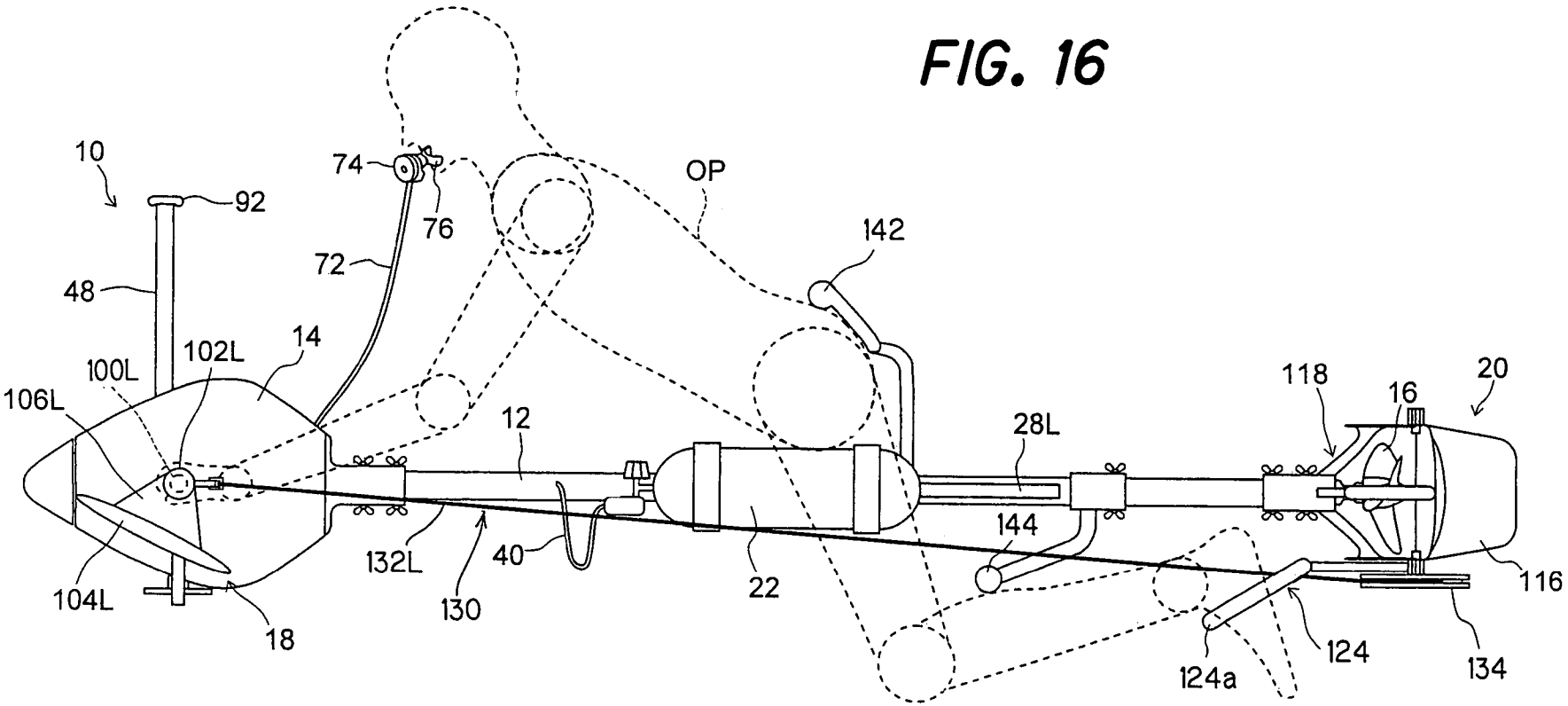
FIG. 16 is also a left-side view of the underwater scooter, with the operator riding thereon, shown in FIG. 1.

In contrast, to make the underwater scooter 10 surface, as shown in FIG. 16, the left and right grips 102L and 102R are rotated so that the left and right elevators 104L and 104R are positioned with their fore edges above their aft edges. When the underwater scooter 10 moves forward in this state, an upward force acts on the left and right elevators 104L and 104R, causing the underwater scooter 10 to surface. In addition, at this time, the operator OP slides forward the first and second air tanks 22 and 24 serving as the saddle area. Namely, the position at which the buoyancy of the first and second air tanks 22 and 24 acts is shifted toward the fore. Thereby, the buoyancy of the fore part of the underwater scooter 10 becomes greater and the fore part of the underwater scooter 10 floats up (the aft part sinks down), thus assuming a posture suited to surfacing (making it easier to surface).

To adjust the direction of forward motion of (steer) the underwater scooter 10, the left and right handlebars 100L and 100R are swiveled around the vertical axis while holding onto the grips 102L and 102R, causing the rudder 116 to swivel around the vertical axis, as shown in FIG. 12 and FIG. 13. In this manner, by manipulating the depth adjusting mechanism 18, the operator OP can also operate the steering mechanism 20. In other words, by manipulating the depth adjusting mechanism 18 that is disposed forward of the riding position of the operator OP (the first and second air tanks 22 and 24) and is thus disposed in a position for superior control, the steering mechanism 20 disposed aft of the riding position can also be operated as a unit.

Note that as described above, the foot stand 124 where the feet of the operator OP are placed is attached to the steering mechanism 20, so when sharp turns are made or when the hydrodynamic drag is large or the like, it is possible to manipulate the foot stand 124 with the feet to assist in the operation of the swivel angle displacement transmission mechanism 130 (namely the operation of swiveling the handlebars 100L and 100R with the arms).

In this manner, the underwater scooter 10 according to the first embodiment is provided with the main frame 12 on which are disposed the first air tank 22 and the second air tank 24 serving as the saddle area or support portion for the operator, the depth adjusting mechanism 18 disposed to the fore of the first and second air tanks 22 and 24, and the steering mechanism 20 disposed to the aft of the first and second air tanks 22 and 24. The depth adjusting mechanism 18 can be swiveled freely around a vertical axis using the swivel mechanism 108, and moreover the angular displacement in this swiveling is transmitted by the swivel angle displacement transmission mechanism 130 to the steering mechanism 20 50 that the rudder 116 swivels around a vertical axis, and thus while the underwater scooter 10 is traveling, the operator can ride upon the main frame 12 and also adjust the depth of travel and direction of forward motion of the underwater scooter 10 by manipulating the depth adjusting mechanism 18 and steering mechanism 20, and thus the operator burden is reduced in comparison to that of the conventional types of scooters that tow the operator.

In particular, by manipulating the depth adjusting mechanism 18 that is disposed forward of the riding position of the operator OP (the first and second air tanks 22 and 24) and is thus disposed in a position for superior control, the steering mechanism 20 disposed aft of the riding position can also be operated as a unit, so ease of operation is improved and the burden of adjusting the depth of travel and direction of forward motion can be effectively reduced.

In addition, the swivel angle displacement transmission mechanism 130 comprises the steering wheel 134 attached to the rudder 116 and the wires 132L and 132R that connect the steering wheel 134 to the depth adjusting mechanism 18, so even with a simple constitution, the angular displacement in the swiveling of the depth adjusting mechanism 18 around a vertical axis is smoothly transmitted to the rudder 116, and thus the steering feel can be improved.

In addition, the first and second air tanks 22 and 24 serving as the saddle area can slide freely in the direction of forward motion of the underwater scooter 10, so the position at which their buoyancy acts can be varied to achieve a suitable posture whether the underwater scooter 10 is diving or surfacing. Thus, the depth of the underwater scooter 10 can be easily adjusted so the burden on the operator can be even more effectively reduced.

Note that in the above, the wires 132L and 132R may also be made to pass through the interior of the main frame 12. In addition, while the drive power that drives the propeller 16 is given as an engine E above, this may also be an electric motor or the like.

In addition, when the underwater scooter 10 is traveling upon the surface of the water or near the surface (namely when the depth of travel is shallow and the upper end of the snorkel 48 is positioned above the surface of the water), the starter grip 92 may be removed from the upper end of the snorkel 48 and held in the notch 48*a* described above (namely so that it does not seal the opening) so that outside air can be taken in as the air used for combustion in the engine E. At this time, the valve 36 connected to the first air tank 22 can be closed so that the supply of air from the first air tank 22 is halted, and thus the consumption of air contained in the tank can be reduced.

Moreover, the snorkel 48 may be connected to the mouthpiece 76 so if the depth of travel of the underwater scooter 10 is shallow, the air for breathing by the operator can also be introduced from outside. At this time, the valve 42 connected to the second air tank 24 may be closed, cutting off the supply of air from the second air tank 24, so the consumption of air contained in the tank can be similarly reduced.

Here follows a description of an underwater scooter according to a second embodiment of the invention. Note that constituent elements that are the same as in the first embodiment are given the same symbols and a description thereof is omitted.

Figure 17:
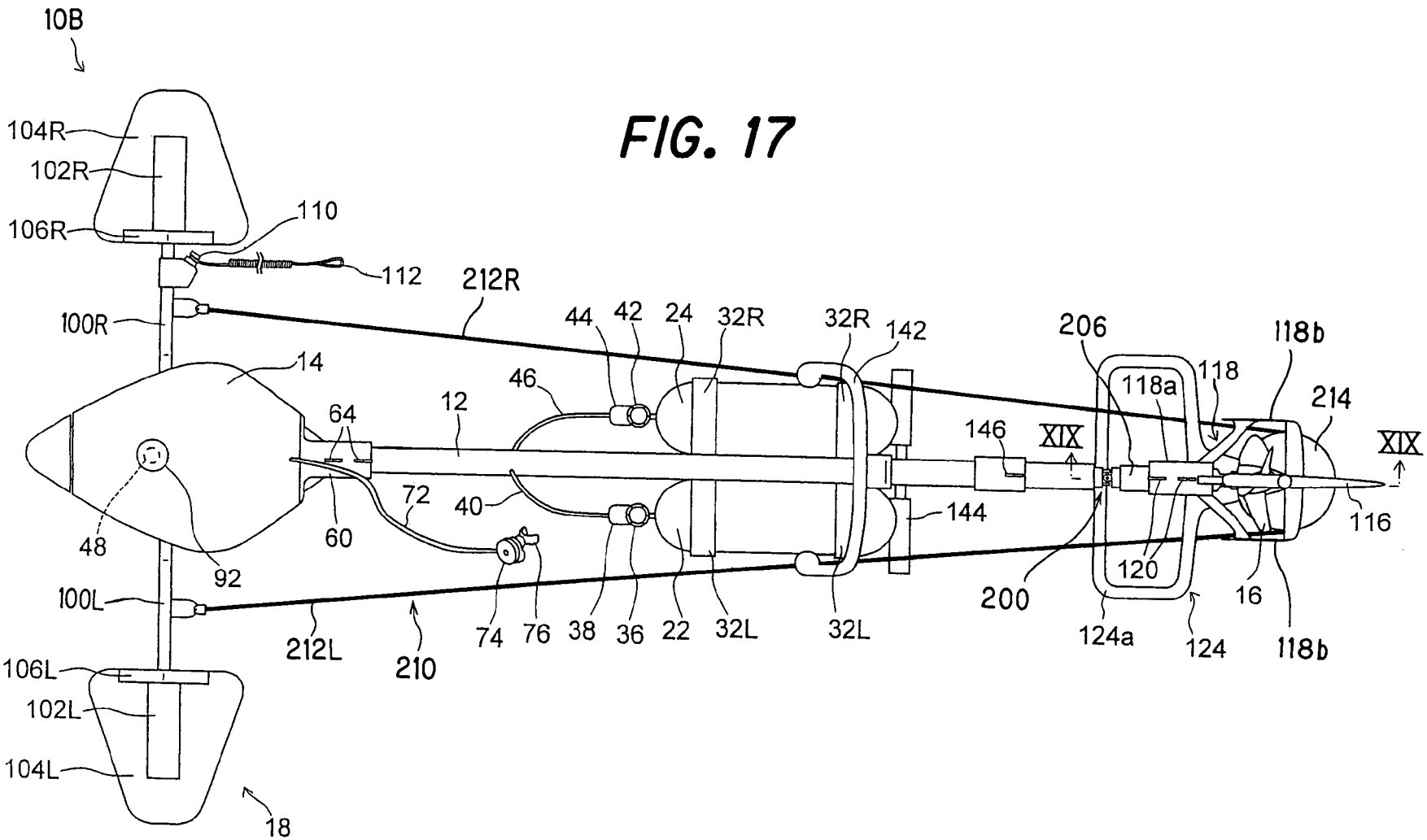
FIG. 17 is a top view of an underwater scooter according to a second embodiment of the invention.
Figure 18:
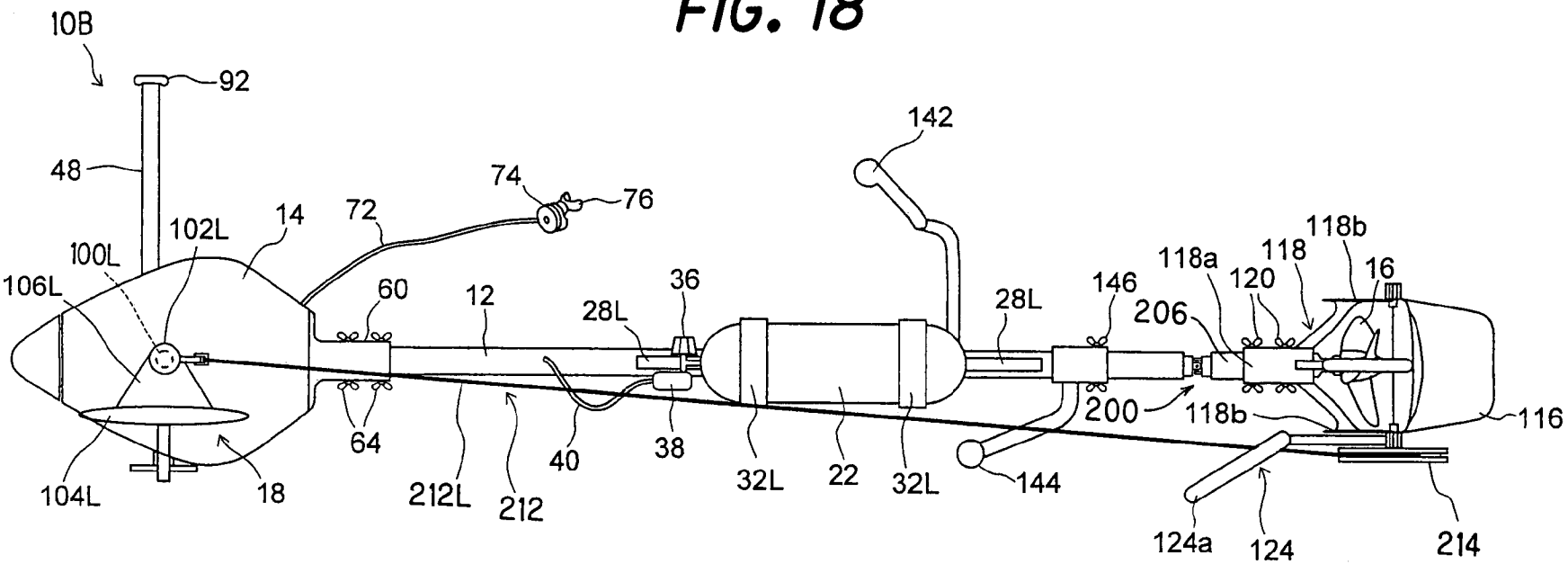
FIG. 18 is a left-side view of the underwater scooter shown in FIG. 17.
Figure 19:
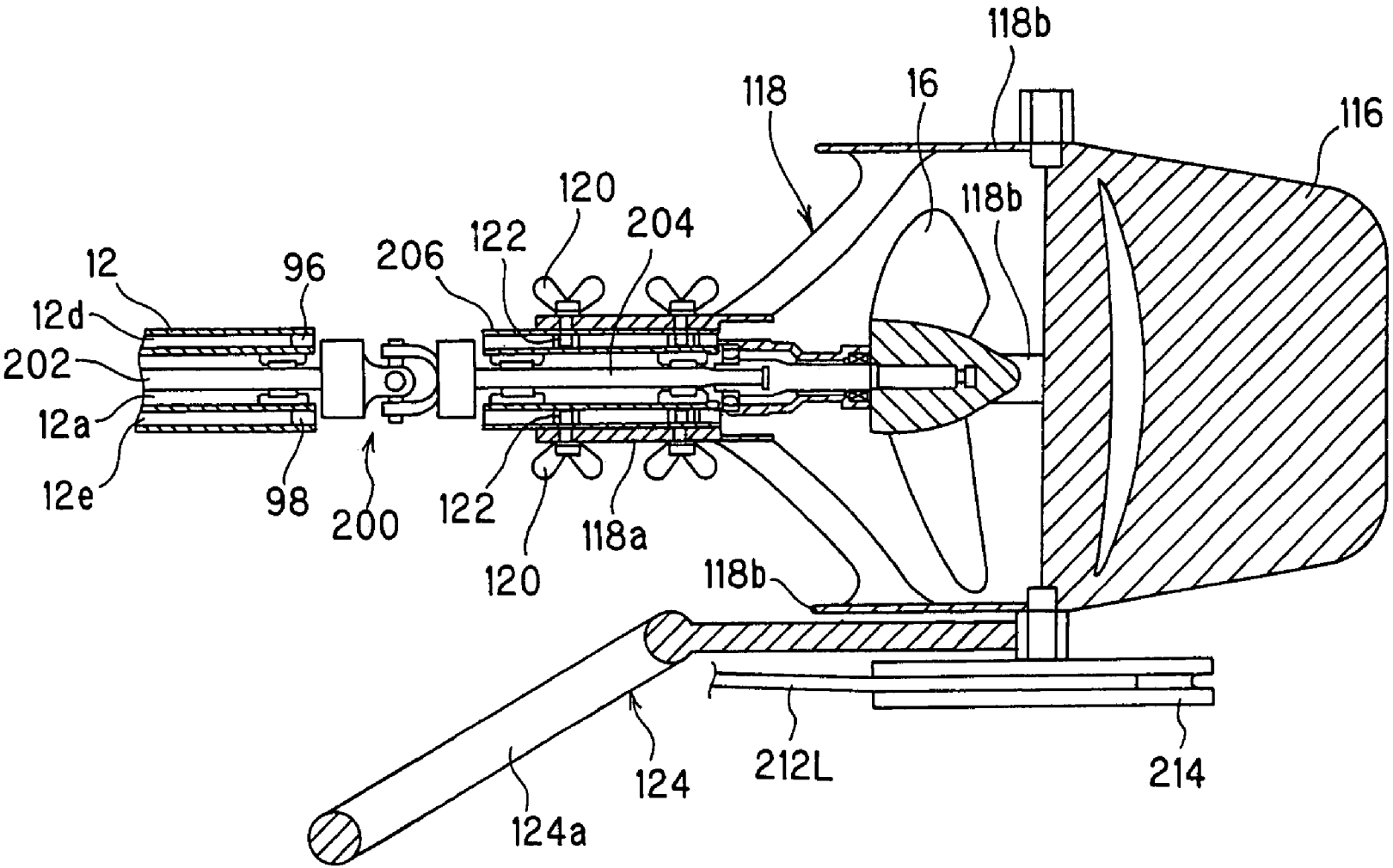
FIG. 19 is an enlarged cross section along the line XIX—XIX in FIG. 17.

FIG. 17 is a top view of an underwater scooter according to the second embodiment. In addition, FIG. 18 is a left-side view of the underwater scooter shown in FIG. 17 and FIG. 19 is an enlarged cross section along the line XIX—XIX in FIG. 17.

With the underwater scooter 10B according to the second embodiment, the driveshaft 26 described in the first embodiment is divided into two parts that are connected with a universal joint 200. In the second embodiment, the shaft connected to the engine E is called the driveshaft and indicated with the symbol 202. In addition, the shaft connected to the propeller 16 is called the propeller shaft and indicated with the symbol 204.

Here follows a description of the differences from the first embodiment in specific detail. As shown in FIG. 19, the propeller shaft 204 connected to the propeller 16 is inserted through a propeller shaft casing 206 and is also connected to the aft end of the driveshaft 202 via the universal joint 200. Specifically, the output of the engine E disposed before the main frame 12 is transmitted via the centrifugal clutch 84, reduction gear mechanism 86, driveshaft 202, universal joint 200 and the propeller shaft 204 to the propeller 16 disposed aft of the main frame 12, thus driving the propeller 16 so that the underwater scooter 10B travels upon the surface of the water or underwater.

Note that the rudder 116 and foot stand 124 are attached to the propeller shaft casing 206.

The underwater scooter 10B is provided with a propeller swivel mechanism 210 that causes the propeller shaft 204 to swivel around a vertical axis using the universal joint 200 as the fulcrum, thus swiveling the propeller 16 around a vertical axis. The propeller swivel mechanism 210 comprises the aforementioned swivel mechanism 108, two wires 212L and 212R (the swivel angle displacement transmission mechanism) and the aforementioned foot stand 124.

To describe the propeller swivel mechanism 210 in detail below, the wire 212L disposed on the left side when looking in the direction of forward motion has one end connected to the left-side handlebar 100L of the depth adjusting mechanism 18 and the other end connected to a steering wheel 214 attached to the lower end of the rudder 116. Similarly, the wire 212R disposed on the right side when looking in the direction of forward motion has one end connected to the right-side handlebar 100R of the depth adjusting mechanism 18 and the other end connected to the steering wheel 214.

Figure 20:
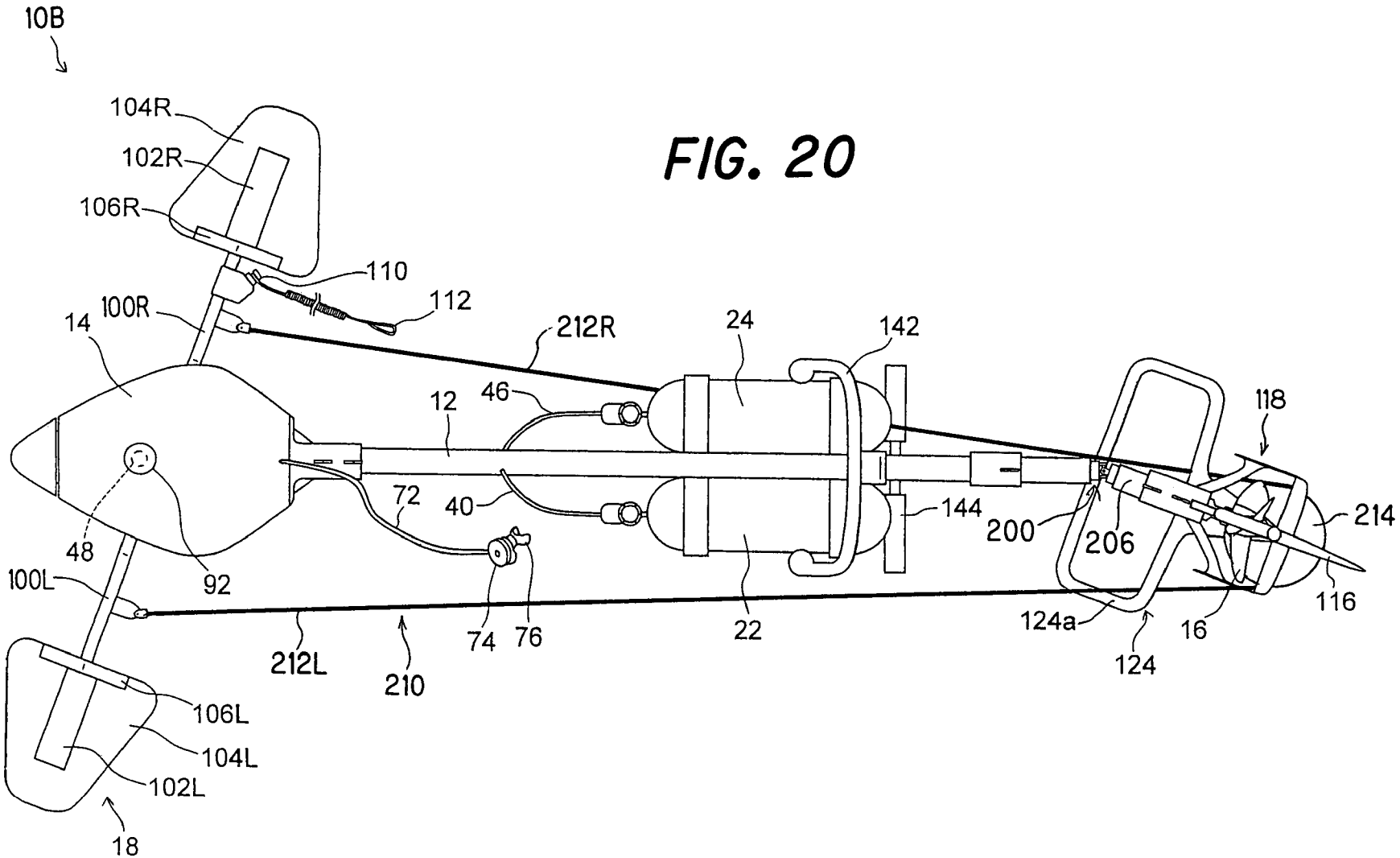
FIG. 20 is a top view of the underwater scooter and illustrating the operation of a propeller swivel mechanism shown in FIG. 17.
Figure 21:
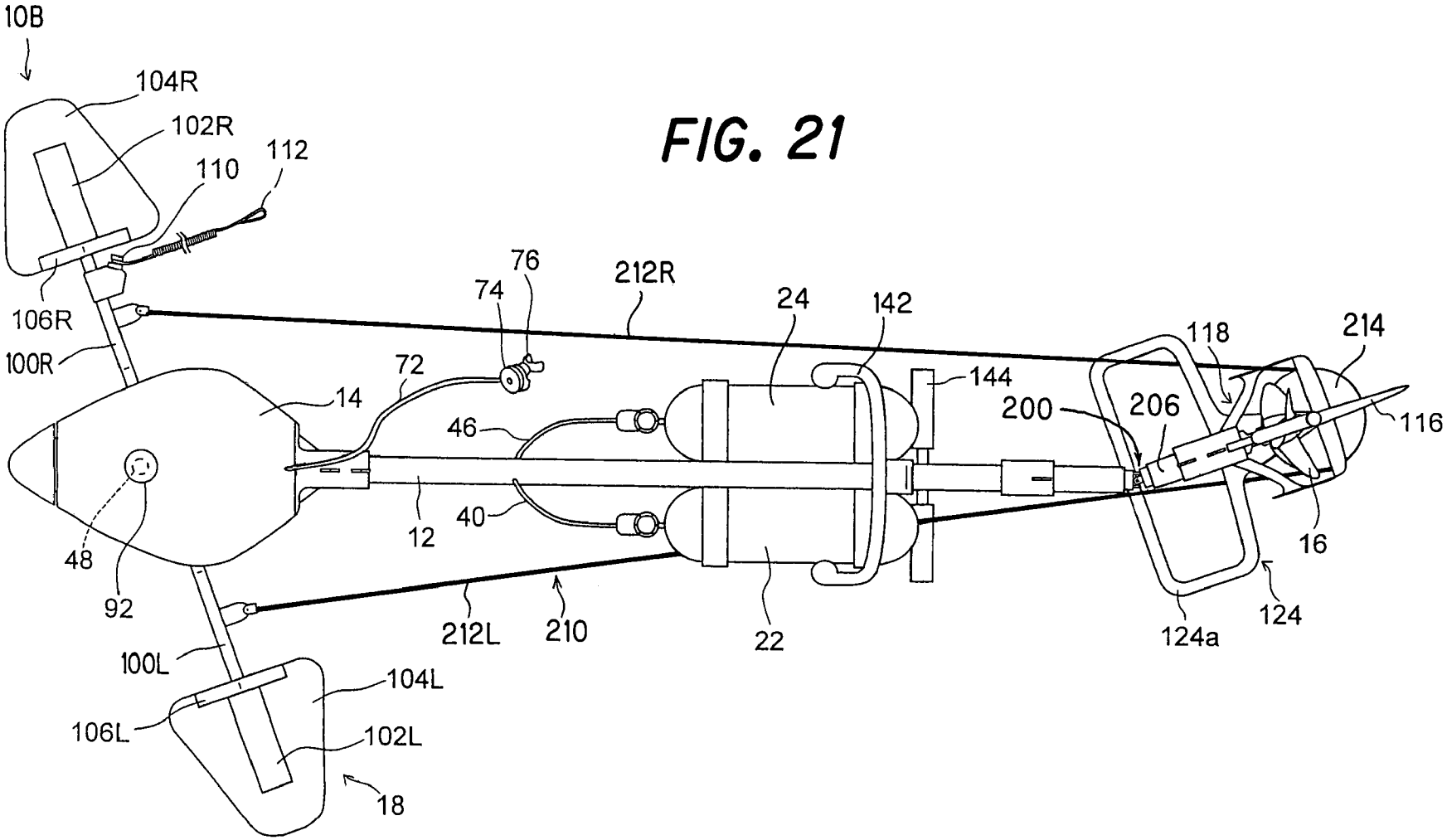
FIG. 21 is a top view of the underwater scooter and also illustrating the operation of the propeller swivel mechanism shown in FIG. 17.

Thereby, the displacement of the depth adjusting mechanism 18 around the vertical axis caused by the swivel mechanism 108 is transmitted by the universal joint 200 to the aft members. Specifically, as shown in FIG. 20 and FIG. 21, when the left and right handlebars 100L and 100R are swiveled around the vertical axis, their displacement is transmitted via the wires 212L and 212R, steering wheel 214 and the like to the propeller shaft casing 206, so the propeller shaft 204 passing through it and the propeller 16 connected to the propeller shaft 204 swivel around the vertical axis. Specifically, the handlebars 100L and 100R can be swiveled around the vertical axis to cause the propeller 16 to swivel around the vertical axis, thus adjusting its orientation (adjusting the direction in which thrust is generated) and causing the underwater scooter 10B to turn.

Note that the wires 212L and 212R are connected on the depth adjusting mechanism 18 side to portions of the respective handlebars 100L and 100R that do not swivel around the lateral axis, so even if the elevators 104L and 104R are swiveled around the lateral axis, the angular displacement in this swiveling is not transmitted to the members aft of the universal joint 200.

In this manner, the underwater scooter 10B according to the second embodiment is provided with the driveshaft 202 that is rotated by the output of the engine E, the universal joint 200 that transmits the rotation of the driveshaft 202 to the propeller shaft 204 connected to the propeller 16, and the propeller swivel mechanism 210 that causes the propeller shaft 204 and the propeller 16 connected thereto to swivel around a vertical axis with the universal joint 200 as the fulcrum, so by manipulating the propeller swivel mechanism 210, the propeller 16 can be made to swivel around a vertical axis (adjusting the orientation of the propeller 16) and cause the underwater scooter 10B to turn. Thus, the burden on the operator, particularly the burden during turning, is reduced in comparison to that of the conventional types of scooters that tow the operator and also good turning performance can be achieved.

In addition, the depth adjusting mechanism 18 disposed before the first air tank 22 and second air tank 24 serving as the saddle area is provided and also, the depth adjusting mechanism 18 can be swiveled freely around a vertical axis using the swivel mechanism 108, and moreover the angular displacement in this swiveling is transmitted by the wires 212L and 212R and the like to the propeller shaft casing 206 so that the propeller 16 swivels around a vertical axis, or in other words, the control systems for adjusting the depth of travel and direction of forward motion of the underwater scooter 10B are disposed in a centralized position forward of the riding position of the operator (namely, in a position for superior control), so it is possible to improve control and also effectively reduce the burden on the operator.

In addition, the foot stand 124 that is to be operated with the feet of the operator is attached to the propeller shaft casing 206, so the orientation of the propeller 16 can be adjusted with a simple constitution.

The remaining meritorious effects are the same as in the first embodiment.

Here follows a description of an underwater scooter according to a third embodiment of the invention.

Figure 22:
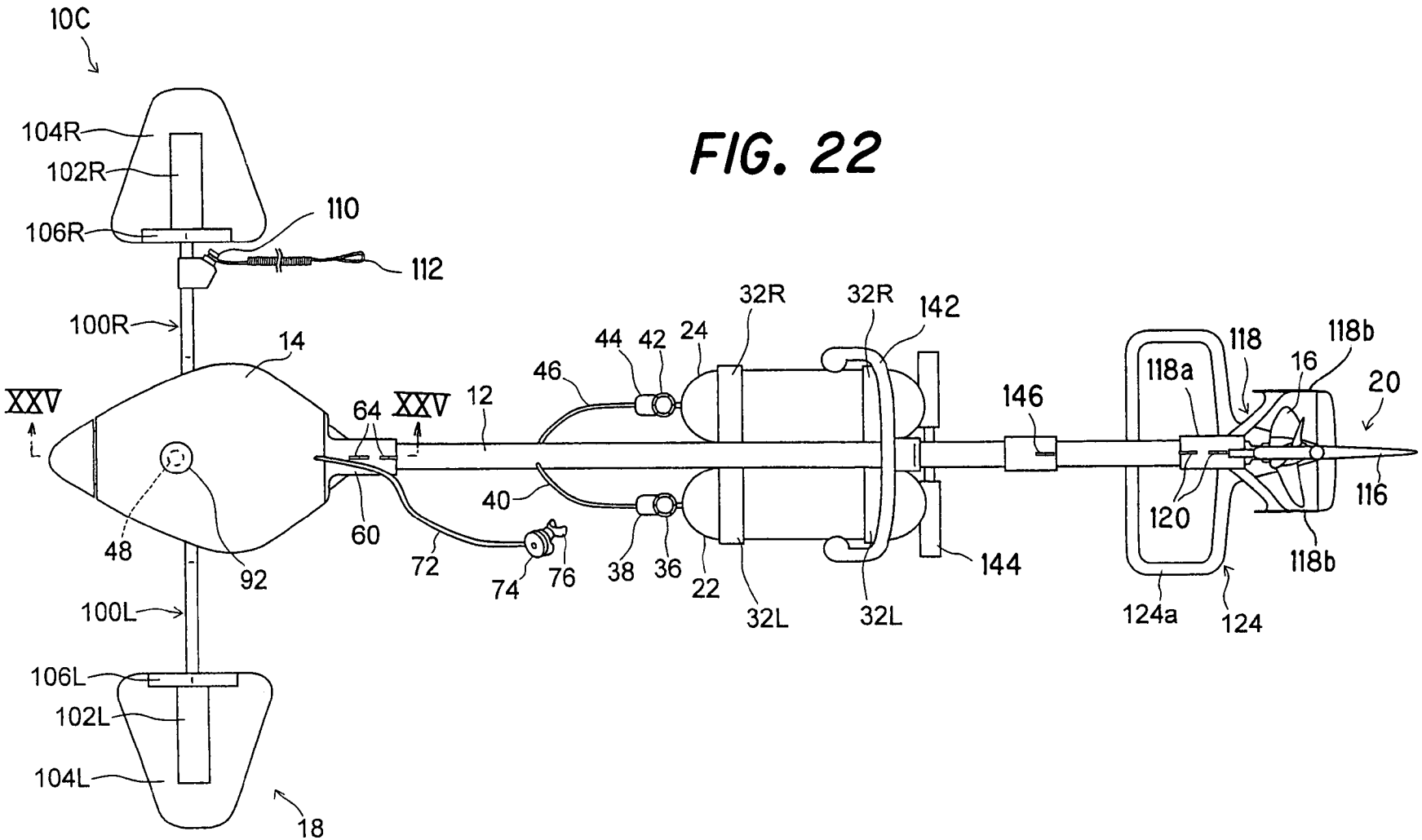
FIG. 22 is a top view of an underwater scooter according to a third embodiment of the invention.
Figure 23:
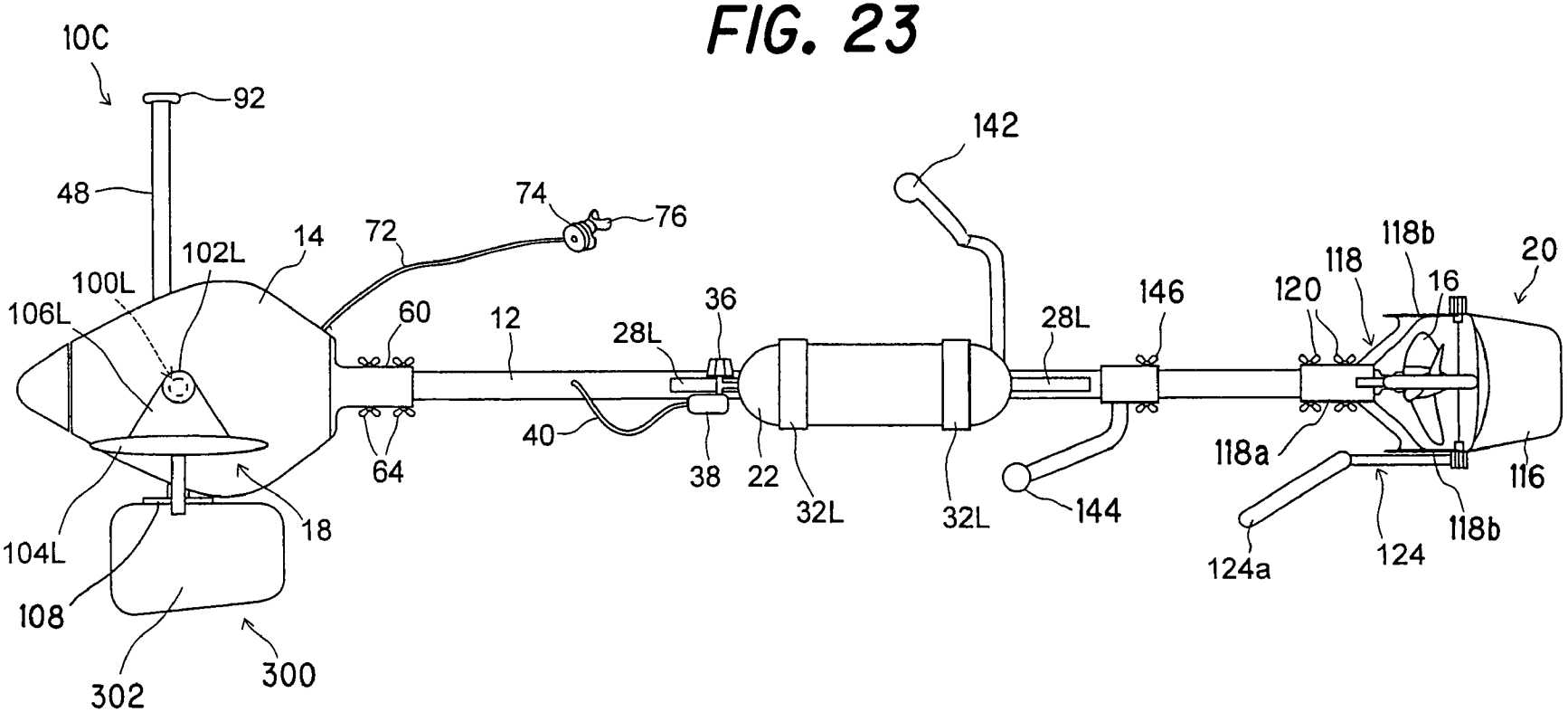
FIG. 23 is a left-side view of the underwater scooter shown in FIG. 22.
Figure 24:
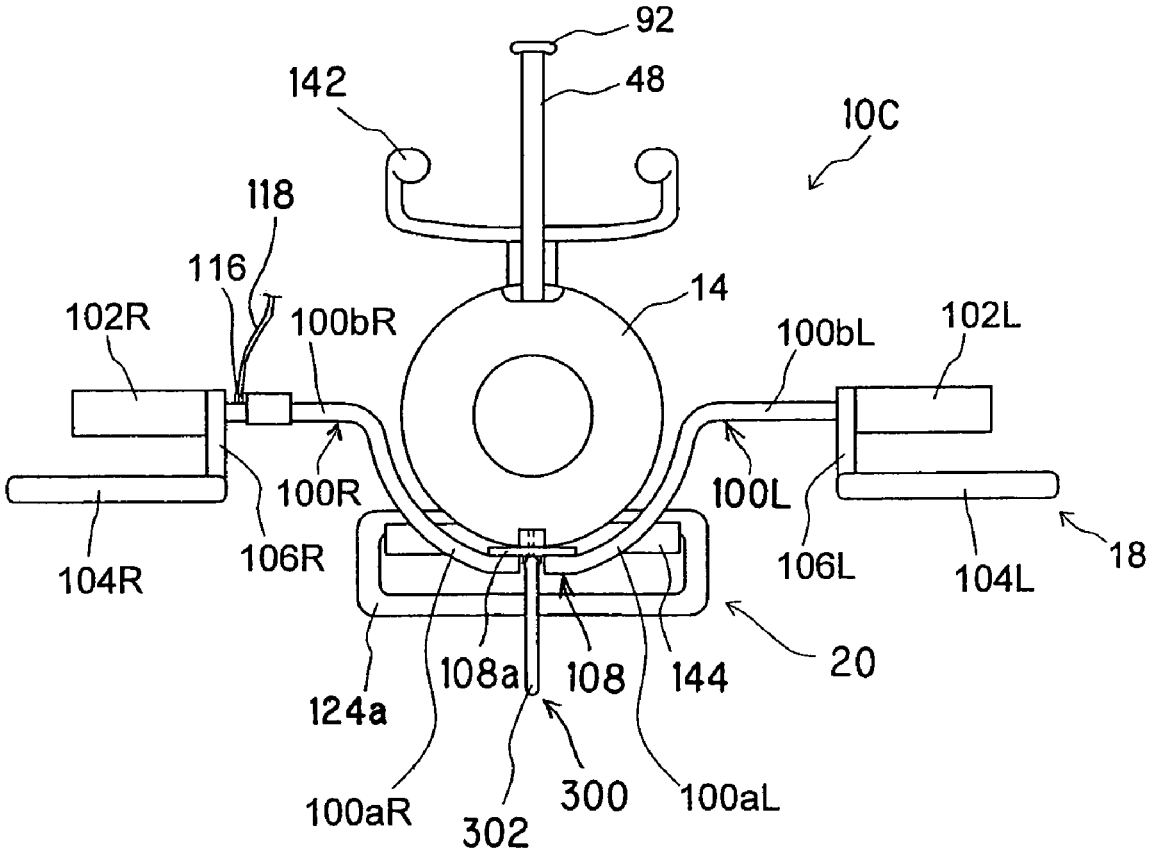
FIG. 24 is a front view of the underwater scooter shown in FIG. 22.

FIG. 22 is a top view of an underwater scooter according to the third embodiment. In addition, FIG. 23 is a left-side view of the underwater scooter shown in FIG. 22. FIG. 24 is a front view of the underwater scooter shown in FIG. 22.

With the underwater scooter 10C according to the third embodiment, in addition to the steering mechanism 20 described in the first embodiment, an additional steering mechanism 300 is disposed below the watertight vessel 14. In the third embodiment, steering mechanism 20 is called the "aft steering mechanism" and steering mechanism 300 is called the "forward steering mechanism."

Figure 25:
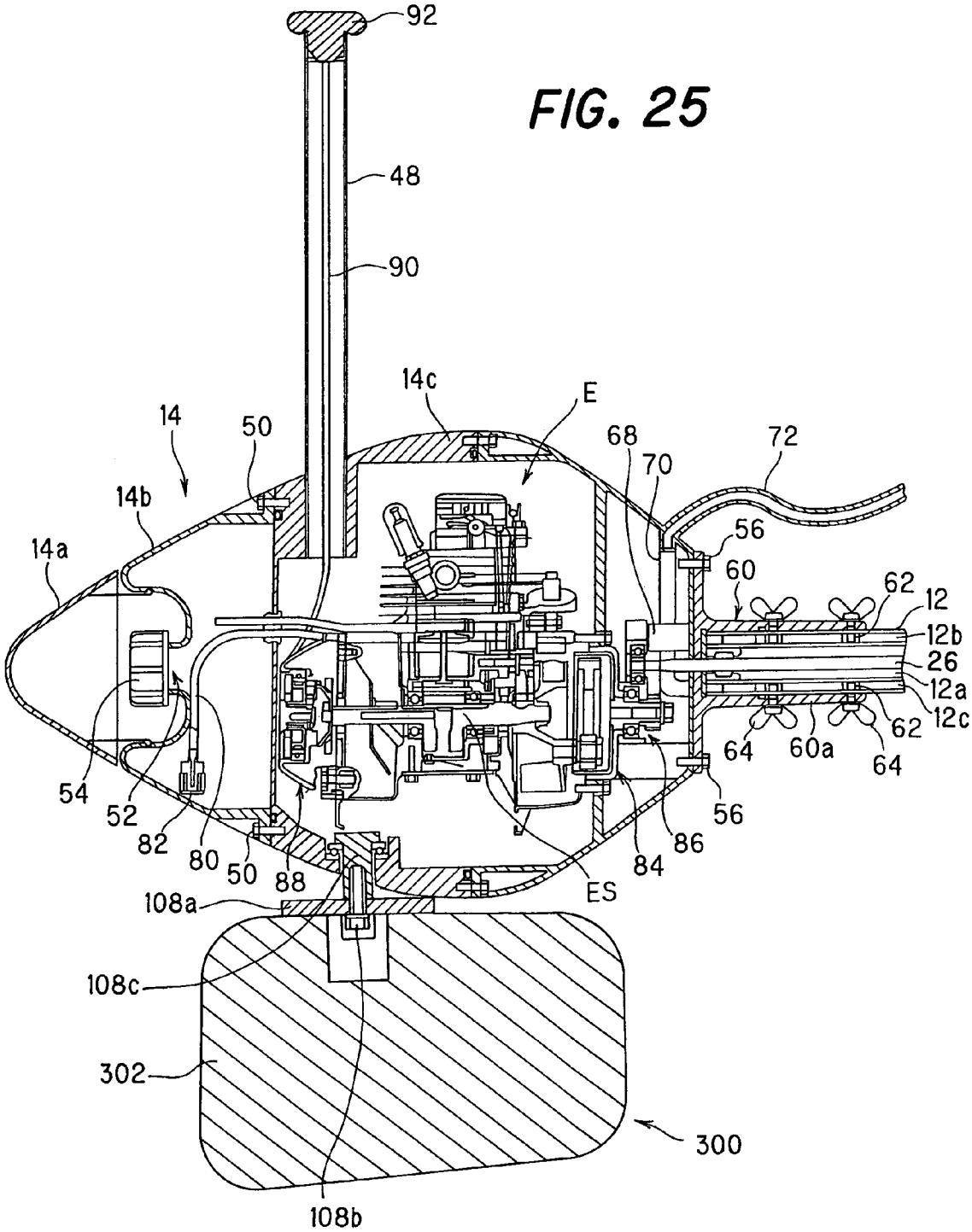
FIG. 25 is an enlarged cross section along the line XXV—XXV in FIG. 22.
Figure 26:
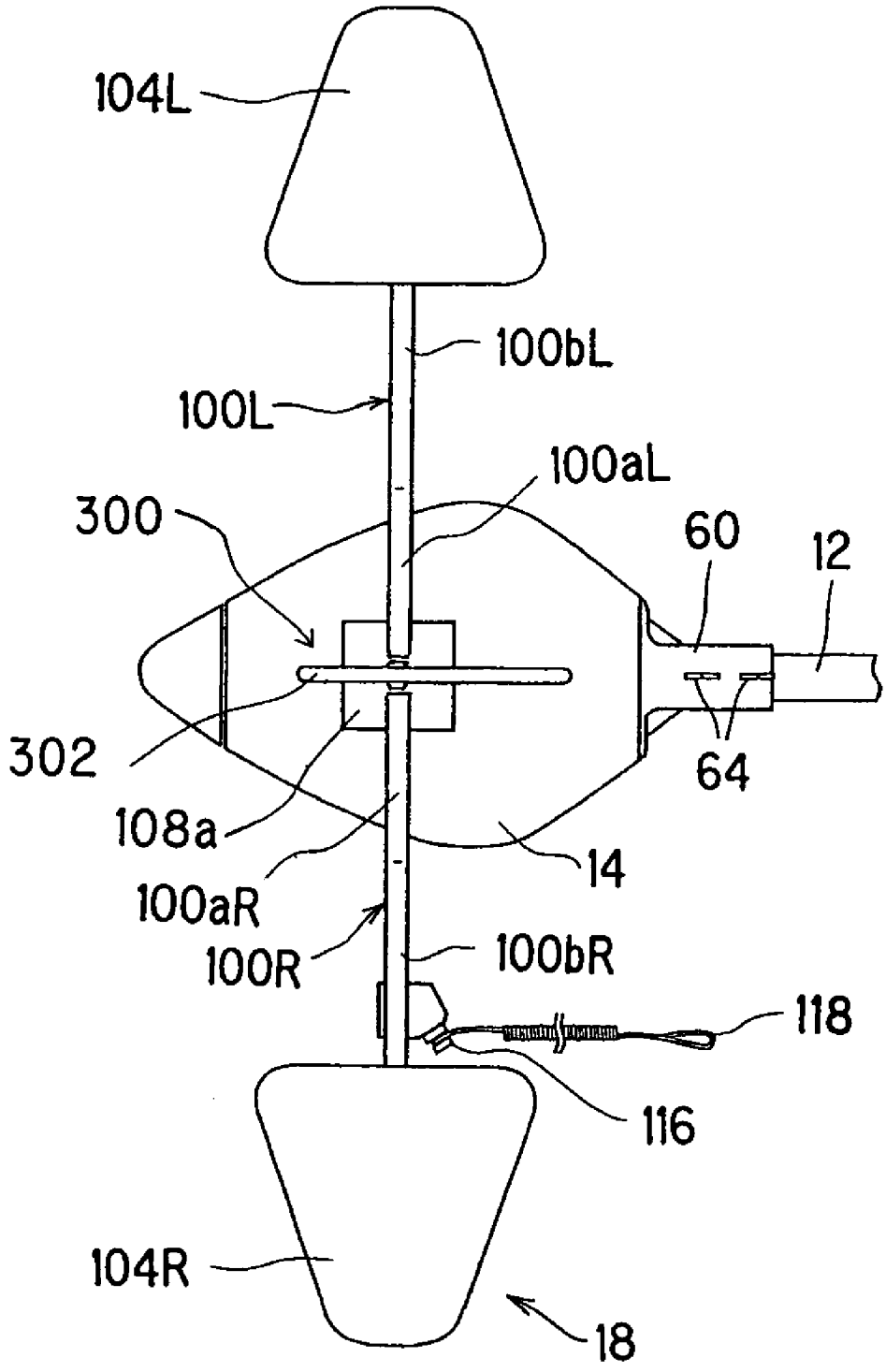
FIG. 26 is a bottom view of the watertight vessel.

FIG. 25 is an enlarged cross section along the line XXV—XXV in FIG. 22. In addition, FIG. 26 is a bottom view of the watertight vessel 14.

As shown in FIGS. 22–26, the depth adjusting mechanism 18 described previously and the forward steering mechanism 300 are disposed near the watertight vessel 14. Specifically, by disposing the depth adjusting mechanism 18 and the forward steering mechanism 300 near the watertight vessel 14, all of the control systems are combined in a single centralized position (in the forward part of the underwater scooter 10, namely forward of the operator).

The forward steering mechanism 300 comprises a forward rudder 302 and the aforementioned left and right handlebars 100L and 100R, left and right grips 102L and 102R and rotating pin 108*c*. Specifically, the depth adjusting mechanism 18 and the forward steering mechanism 300 are connected with some members used in common.

Figure 27:
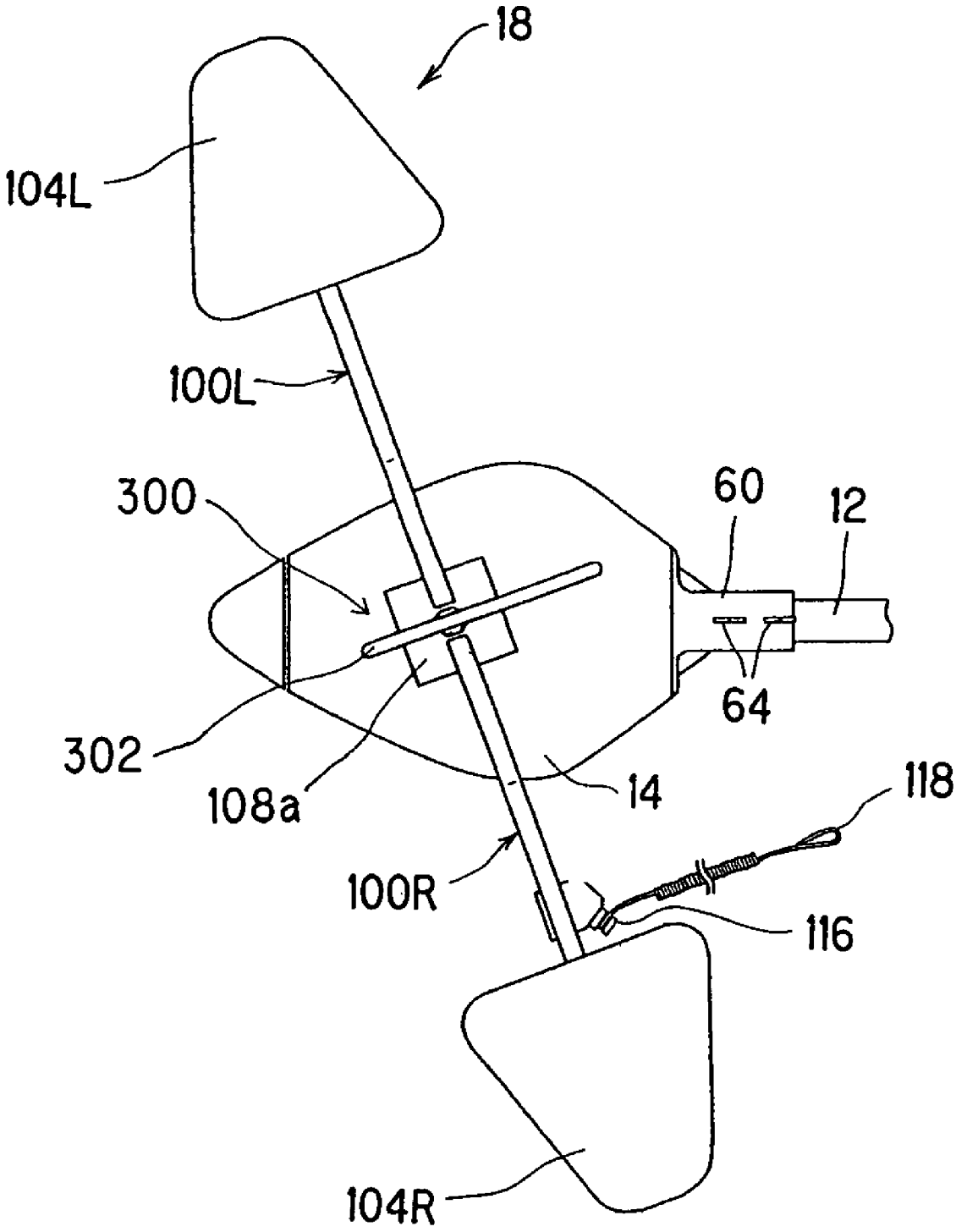
FIG. 27 is a bottom view of the underwater scooter and illustrating the operation of a forward steering mechanism shown in FIG. 23.
Figure 28:
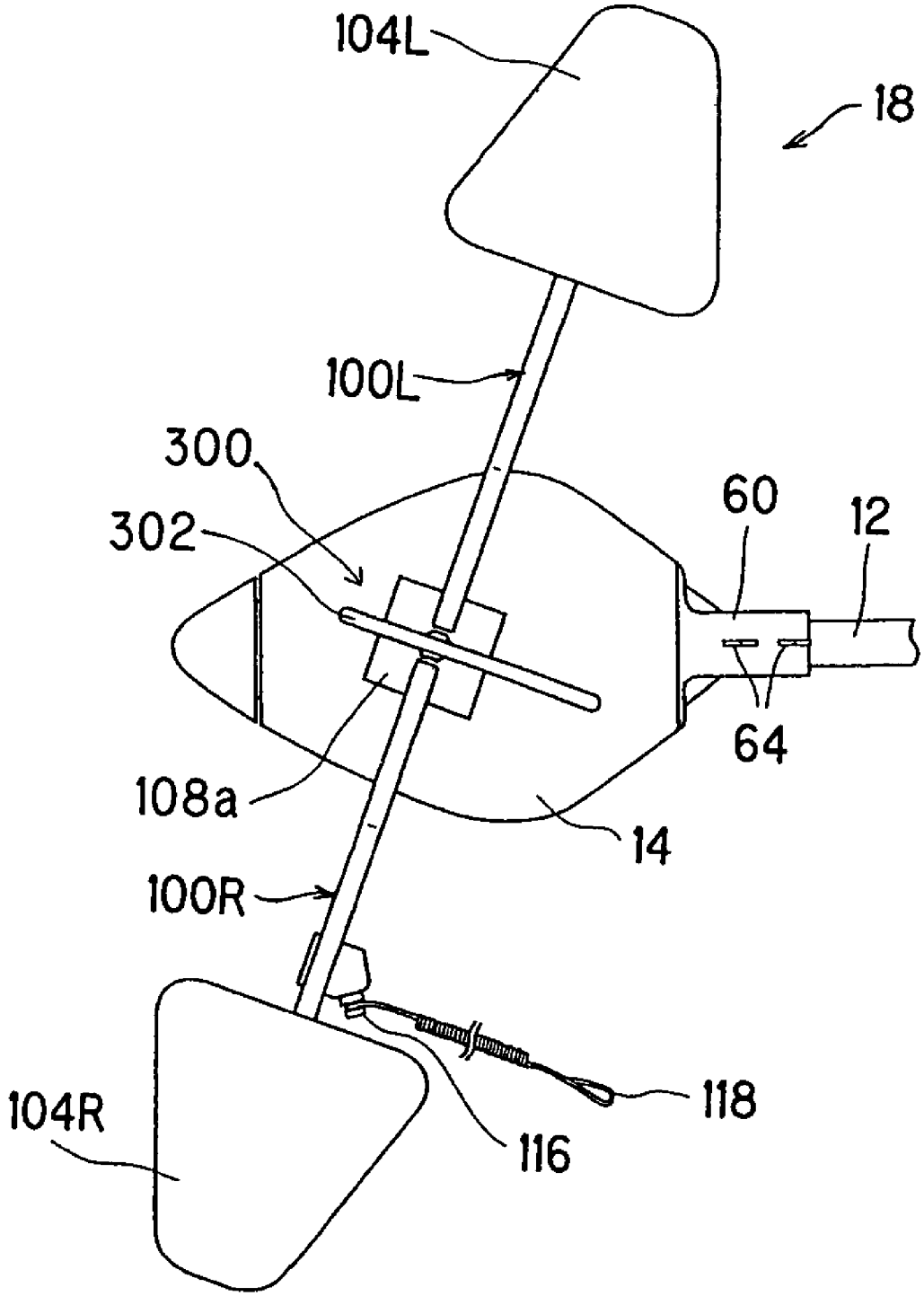
FIG. 28 is also a bottom view of the underwater scooter and illustrating the operation of the forward steering mechanism shown in FIG. 23.

The forward rudder 302 is attached to the rotating pin 108*c* via the plate 108*a* and bolt 108*b*. Specifically, the forward rudder 302 is able to rotate freely around a vertical axis together with the left and right handlebars 100L and 100R. Accordingly, by holding onto the grips 102L and 102R and turning the handlebars 100L and 100R (rotating them around a vertical axis), the forward rudder 302 can be made to swivel around a vertical axis, and thus the direction of forward motion of the underwater scooter 10C can be adjusted, as shown in FIGS. 27 and 28.

In this manner, by connecting the depth adjusting mechanism 18 and forward steering mechanism 300 disposed near the watertight vessel 14, or specifically, by connecting the components to be controlled by the operator (handlebars 100L and 100R and grips 102L and 102R) and making them into a common unit, the various mechanisms can be controlled freely as a single unit.

In this manner, with the underwater scooter 10C according to the third embodiment, the depth adjusting mechanism 18 and forward steering mechanism 300 can be controlled to adjust the depth of travel and direction of forward motion of the underwater scooter 10C, so the burden can be further lightened.

In particular, by disposing the depth adjusting mechanism 18 and forward steering mechanism 300 near the watertight vessel 14, the various control systems are centralized in a single place (before the operator), and more specifically, by using common components to be controlled by the operator (handlebars 100L and 100R and grips 102L and 102R) and connecting them to the various mechanisms, they can be controlled freely as a single unit, so the ease of controlling the various mechanisms is improved, and thus the burden on the operator accompanying the adjustment of the direction of forward motion and depth of travel can be even more effectively lightened.

The remaining meritorious effects are the same as in the first embodiment.

Note that while both the forward steering mechanism 300 and the aft steering mechanism 20 were provided above, the forward steering mechanism 300 alone may also be used.

Here follows a description of an underwater scooter according to a fourth embodiment of the invention.

Figure 29:
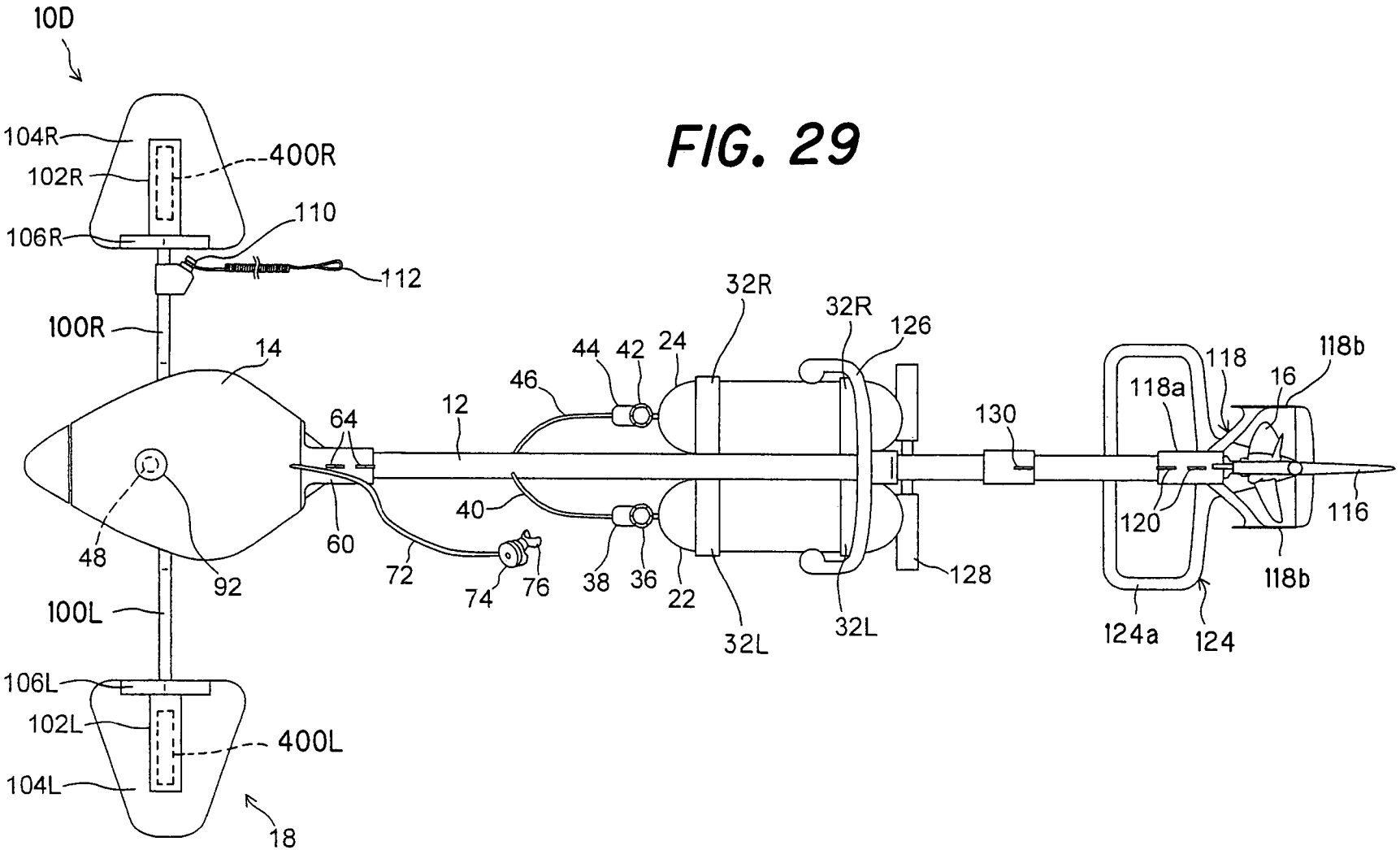
FIG. 29 is a top view of an underwater scooter according to a fourth embodiment of the invention.
Figure 30:
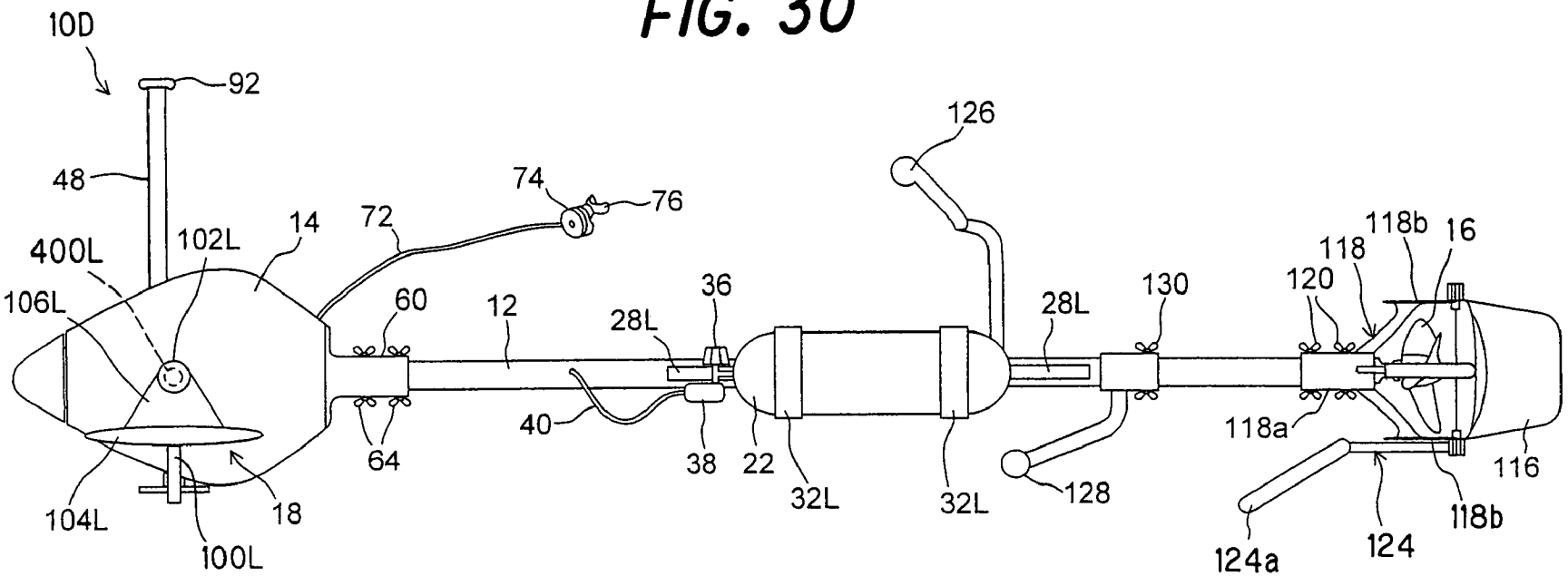
FIG. 30 is a left-side view of the underwater scooter shown in FIG. 29.
Figure 31:
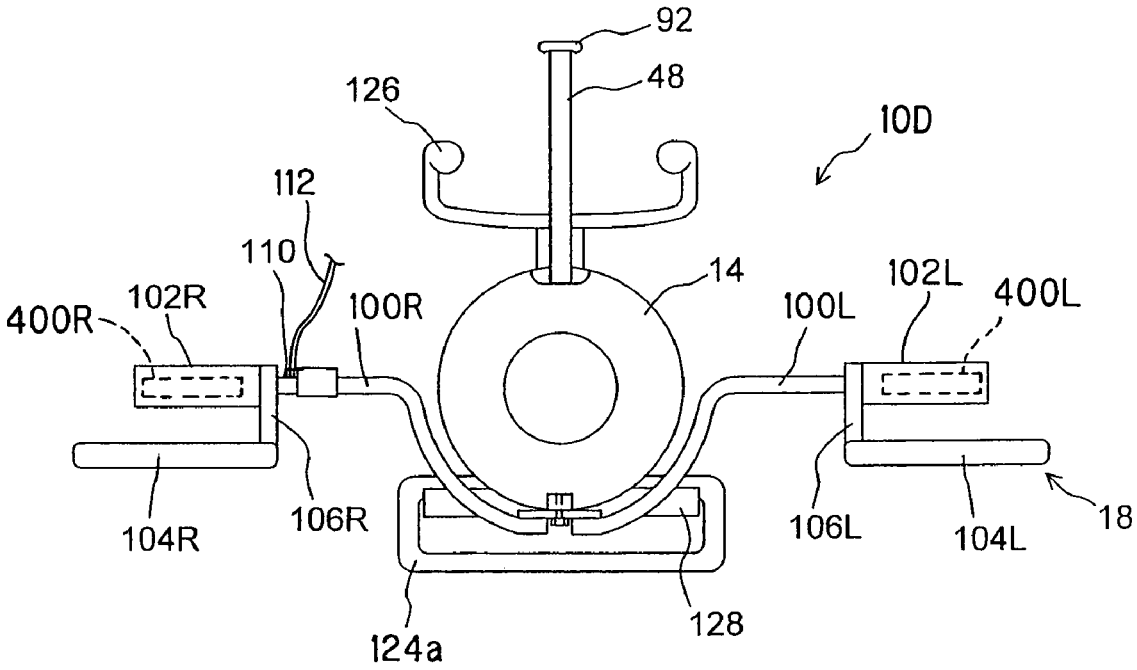
FIG. 31 is a front view of the underwater scooter shown in FIG. 29.

FIG. 29 is a top view of an underwater scooter according to the fourth embodiment. In addition, FIG. 30 is a left-side view of the underwater scooter shown in FIG. 29. FIG. 31 is a front view of the underwater scooter shown in FIG. 29.

With the underwater scooter 10D according to the fourth embodiment, the left and right elevators 104L and 104R are able to swivel independently up to their vertical positions, so the depth adjusting mechanism 18 described in the first embodiment can also be made to function as a steering mechanism.

As described above, the left and right handlebars 100L and 100R are attached to the watertight vessel 14, and they are disposed such that their lengthwise direction is parallel to a direction lateral to the underwater scooter 10. The left grip 102L is attached to the end of the handlebar 100 on the left side when viewed in the direction of forward motion. Similarly, the right grip 102R is attached to the end of the handlebar 100 on the right side when viewed in the direction of forward motion. Note that each of the left and right grips 102L and 102R is attached so that it is able to turn (specifically, rotate) freely around the handlebar 100 as the center of rotation.

Figure 32:
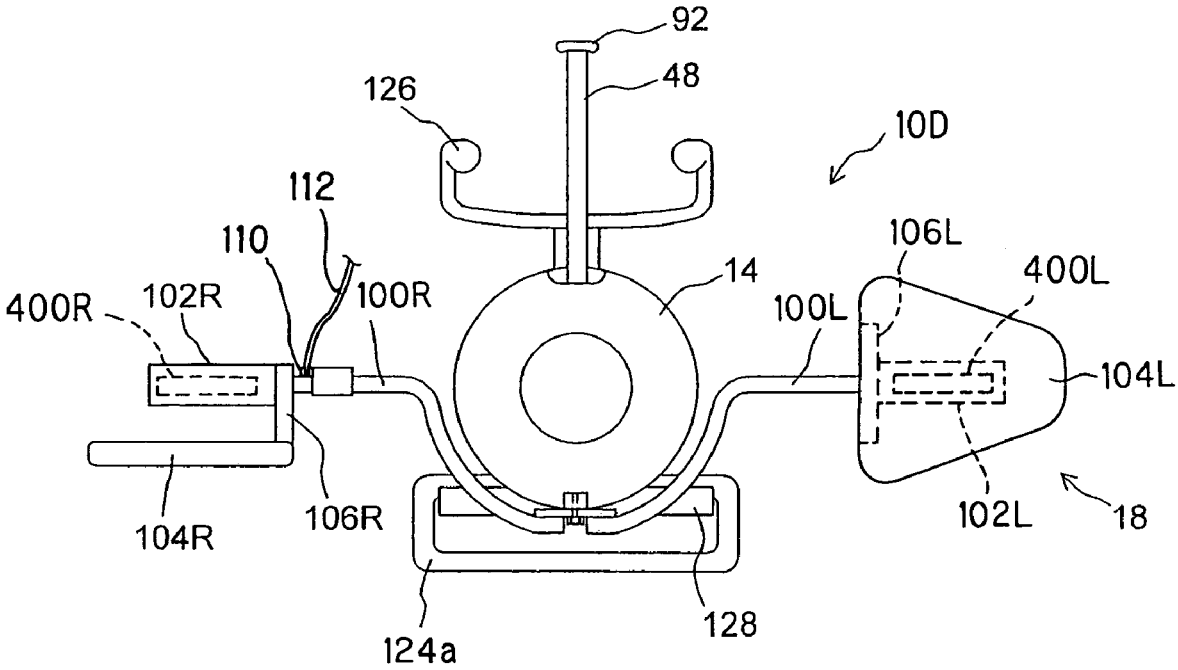
FIG. 32 is a front view of the underwater scooter shown in FIG. 29 and illustrating its operation.
Figure 33:
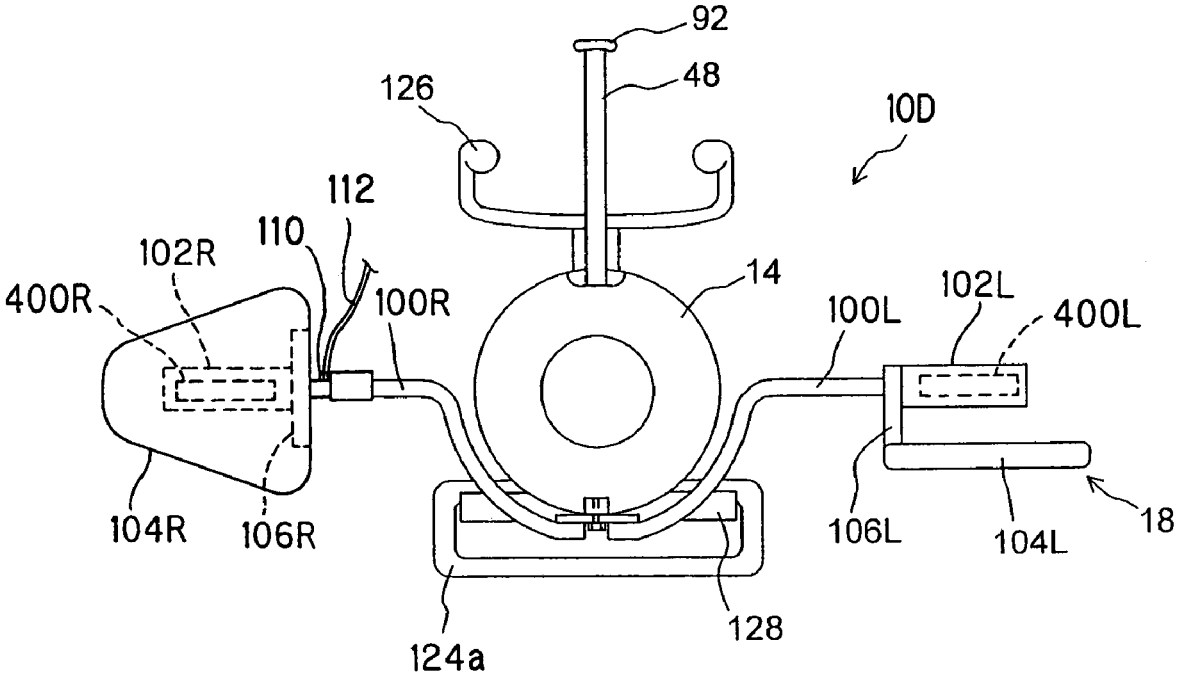
FIG. 33 is also a front view of the underwater scooter shown in FIG. 29 and illustrating its operation.

Accordingly, as shown in FIG. 32 and FIG. 33, by operating the grips 102L and 102R connected to the elevators 104L and 104R independently at different swivel angles to the left and right (causing the surface area in projection toward the front of the elevators to be different), the hydrodynamic resistance (drag) acting on the left and right elevators 104L and 104R can be made different, and this action can be used to steer the underwater scooter 10D. Note that as shown in FIG. 32 and FIG. 33, the elevators 104L and 104R can be swiveled independently up to their vertical positions.

In addition, as shown in FIGS. 29–33, the left-side grip 102L is provided with a left-side locking mechanism 400L (left-side elevator swivel angle maintaining mechanism) that locks its rotation and maintains the swivel angle of the left-side elevator 104L. Similarly, the right-side grip 102R is provided with a right-side locking mechanism 400R (right-side elevator swivel angle maintaining mechanism) that locks its rotation and maintains the swivel angle of the right-side elevator 104R.

Figure 34:
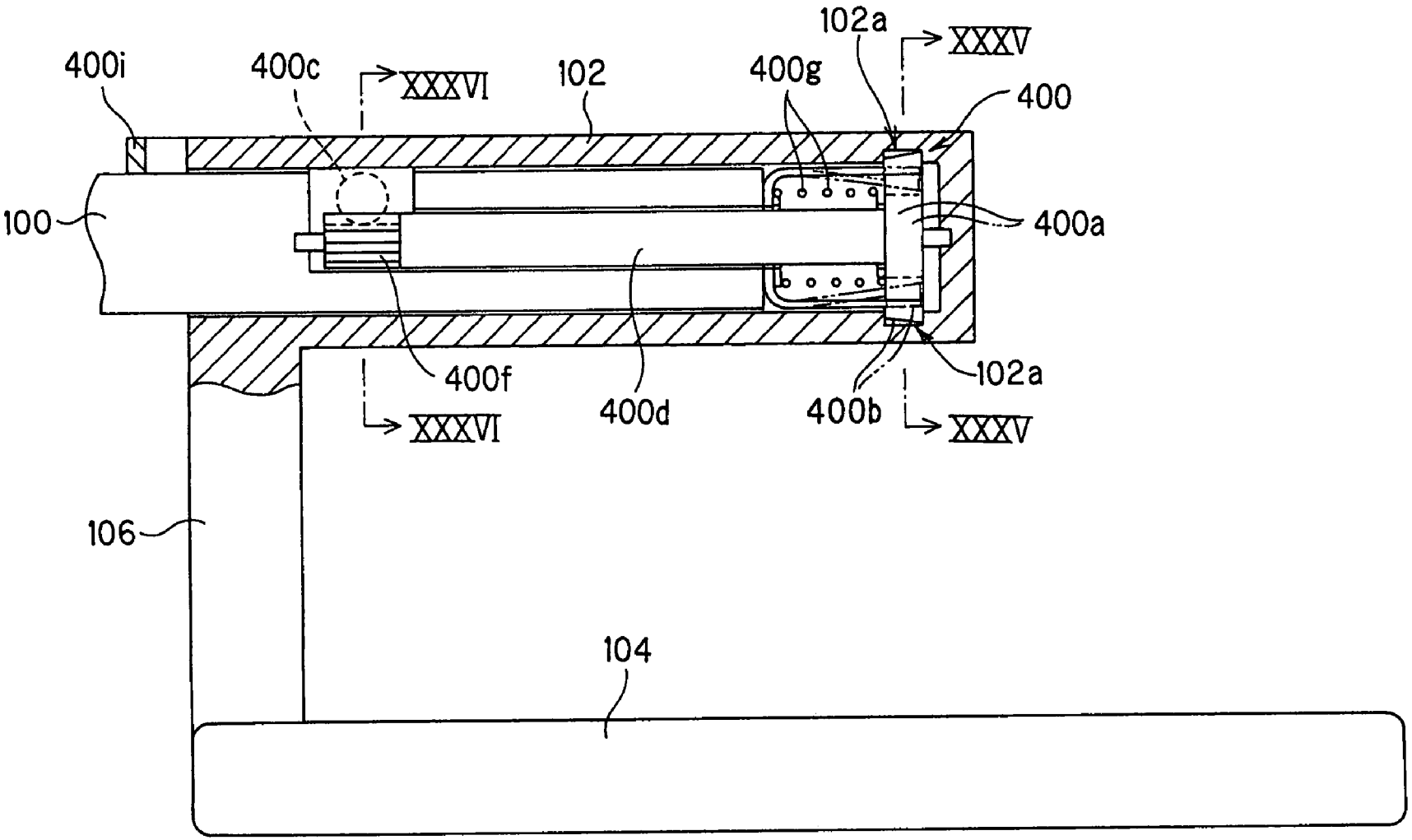
FIG. 34 is an enlarged explanatory diagram of the area near a grip shown in FIG. 29.
Figure 35:
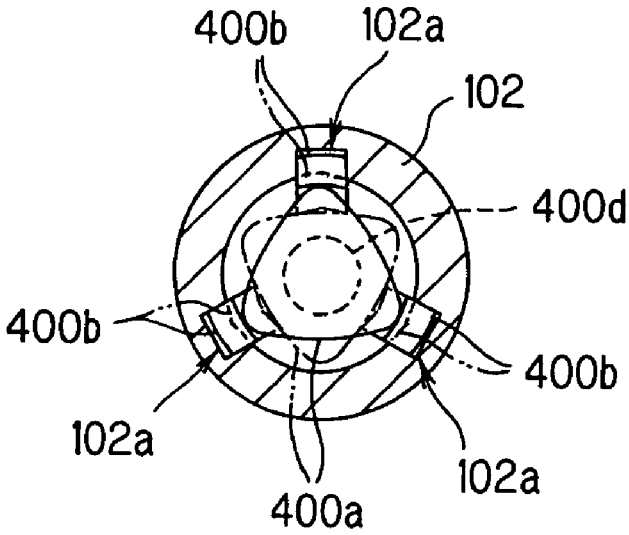
FIG. 35 is an enlarged cross section along the line XXXV—XXXV in FIG. 34.
Figure 36:
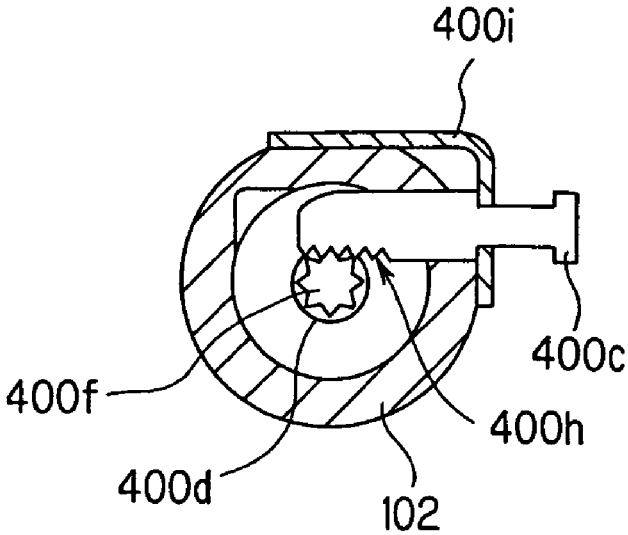
FIG. 36 is an enlarged cross section along the line XXXVI—XXXVI in FIG. 34.

FIG. 34 is an enlarged explanatory diagram of the area near the grip 102. In addition, FIG. 35 is an enlarged cross section along the line XXXV—XXXV in FIG. 34. FIG. 36 is an enlarged cross section along the line XXXVI—XXXVI in FIG. 34. Here follows a description of the locking mechanism 400 made with reference to FIGS. 34–36. Note that the locking mechanism 400 has lateral symmetry, so "L" and "R" will be omitted from the following description.

As shown in FIG. 34, the grip 102 is provided with a locking mechanism 400. As shown in FIGS. 34–36, the locking mechanism 400 comprises a cam 400*a*, ratchet 400*b*, unlocking switch 400*c* and other components. Note that in FIG. 34 and FIG. 35, the cam 400*a* and ratchet 400*b* are indicated with solid lines when locked, and with two-dot chain lines when unlocked (in the initial state).

A shaft 400*d* is rotatably inserted through the interior of the handlebar 100, with one end of the shaft 400*d* connected to the cam 400*a* and a gear 400*f* formed on the other end.

A ratchet 400*b* and a return spring 400*g* are attached to the tip of the handlebar 100. The ratchet 400*b* comprises three elastically deformable feet disposed at 120° intervals in the direction of rotation of the grip 102, and three pawls provided upon their tips. In addition, the return spring 400*g* specifically comprises a twisted coil spring, with one end attached to the tip of the handlebar 100 and the other end attached to the cam 400*a*. Note that as shown in FIG. 35, the cam 400*a* has the shape of a rounded equilateral triangle, and touches the three pawls of the ratchet 400*b*.

The bias of the return spring 400*g* causes the cam 400*a* to be constantly held in a position such that its three vertices touch the three pawls of the ratchet 400*b*. In addition, three indentations 102*a* that are to engage the three pawls of the ratchet 400*b* are formed at 120° intervals along the internal circumference of the grip 102. Accordingly, when the operator rotates the grip 102 to a position at which the three indentations 102*a* are directly above the three pawls of the ratchet 400*b*, the biasing force of the return spring 400*g* causes the cam 400*a* to rotate and the vertices of the cam 400*a* to touch the pawls of the ratchet 400*b* (in other words, the feet of the ratchet 400*b* elastically deform so the pawls are displaced outward so as to expand), and thus the pawls engage the indentations 102*a*. Thereby, the rotation of the grip 102 is locked and the swivel angle of the elevator 104 is maintained. Note that the positions of the indentations 102*a* and the like are set so that the elevator 104 can be maintained in at least at the vertical position, or namely so that the swivel angle can be maintained at 90° (taking 0° to be the swivel angle at which the elevator 104 is horizontal).

Here follows a description of unlocking. As shown in FIG. 36, gear teeth 400*h* are formed on one end of the unlocking switch 400*c*, and the gear teeth 400*h* engage the gear 400*f* described previously in the interior of the grip 102. In addition, the other end of the unlocking switch 400*c* protrudes outside of the grip 102 so that it can be manipulated by the operator. Note that the unlocking switch 400*c* is supported at an appropriate position above the grip 102 by means of a stay 400*i* attached to the handlebar 100.

When the operator manipulates the unlocking switch 400*c* (specifically, when it is pressed to overcome the biasing force of the return spring 400*g*), the shaft 400*d* and cam 400*a* are rotated via the gear teeth 400*h* and gear 400*f*. Thereby, the contact between the vertices of the cam 400*a* and the pawls is released and the pawls return to their initial positions. Thus, the engagement between the pawls of the ratchet 400*b* and the indentations 102*a* is released and the grip 102 is free to rotate.

Here follows a description of the adjustment of the direction of forward motion of the underwater scooter 10D. When the underwater scooter 10D is to be turned left, as shown in FIG. 32, the left grip 102L is manipulated to swivel the left elevator 104L to the vertical position, thus increasing the hydrodynamic resistance (drag) on the left side of the underwater scooter 10D in comparison to its right side. On the other hand, when the underwater scooter 10D is to be turned right, as shown in FIG. 33, the right grip 102R is manipulated to swivel the right elevator 104R to the vertical position, thus increasing the hydrodynamic resistance (drag) on the right side of the underwater scooter 10D in comparison to its left side.

In this manner, the underwater scooter 10D can be steered by manipulating the left and right elevators 104L and 104R independently to make their swivel angles different. On the other hand, if the left and right elevators 104L and 104R are manipulated in the same manner so that their swivel angles agree, the underwater scooter 10D can be made to dive or surface. Moreover, by combining these types of manipulation, operations such as steering while diving or surfacing are possible. Namely, the left and right elevators 104L and 104R can be manipulated to adjust both the depth of travel and direction of forward motion of the underwater scooter 10D. Note that the swivel angles of the elevators 104L and 104R are maintained independently by the locking mechanisms 400L and 400R, so when adjusting the depth of travel or direction of forward motion, there is no need for the operator to use their own strength to maintain the swivel angles of the elevators 104L and 104R.

In this manner, with the underwater scooter 10D according to the fourth embodiment, the left and right elevators 104L and 104R are provided on the left and right sides in the direction of forward motion, and are also able to swivel independently up to their vertical positions, so the left and right elevators 104L and 104R can be manipulated to adjust both the depth of travel and direction of forward motion of the underwater scooter 10D, and thus the ease of control is improved, and the burden on the operator accompanying the adjustment of the direction of forward motion and depth of travel can be lightened.

In addition, the left and right grips 102L and 102R connected to the elevators 104L and 104R are provided with the locking mechanisms 400L and 400R that independently maintain the swivel angles of the elevators 104L and 104R, so when adjusting the depth of travel or direction of forward motion, there is no need for the operator to use their own strength to maintain the swivel angles of the elevators 104L and 104R, and thus the burden on the operator accompanying the adjustment of the direction of forward motion and depth of travel can be lightened even further. The remaining meritorious effects are the same as in the first embodiment.

As mentioned above, the first embodiment is configured to have an underwater scooter 10 operable to enable a user to travel on a surface of water or underwater, comprising: a main frame 12 having a saddle area for supporting an operator thereon; a watertight vessel 14 disposed on the main frame toward a fore in a direction of forward motion of the scooter; a drive power unit (internal combustion engine E) enclosed within an interior of the watertight vessel; a propeller 16 disposed on the main frame toward an aft end thereof in the direction of forward motion of the scooter; a driveshaft 26 passing through an interior of the main frame and adapted to transmit an output of the drive power unit to the propeller so as to turn it; a steering mechanism 20 enabling the scooter to be steered; and a depth adjusting mechanism 18 enabling the scooter to dive or surface.

In the underwater scooter, the steering mechanism 29 is disposed at a position below the watertight vessel 14 in a direction of gravity, and the depth adjusting mechanism 18 is disposed at each side of the watertight vessel 14.

In the underwater scooter, the steering mechanism 20 and the depth adjusting mechanism 18 are connected together to be a common unit operable by the operator.

In the under water scooter, the depth adjusting mechanism 18 has an elevator 104L, 104R that swivels around a lateral axis with respect to the main frame 12, and the steering mechanism 20 has a rudder 116 disposed at a position closer to the aft end, than the saddle area, in the direction of forward motion, that swivels around a vertical axis, and further including: a swivel mechanism 108 enabling the depth adjusting mechanism 18 to swivel around a vertical axis relative to the main frame; and a swivel angle displacement transmission mechanism 130 transmitting an angular displacement around the vertical axis of the depth adjusting mechanism 18 to the steering mechanism such that the rudder 116 swivels around the vertical axis.

In the underwater scooter, the swivel angle displacement transmission mechanism 130 has one end that is connected to the depth adjusting mechanism 18 and another end that comprises a wire 132L, 132R connected to the steering mechanism 20.

In the underwater scooter, the swivel angle displacement transmission mechanism 130 has a steering wheel 134 that is connected to the rudder 116, such that other end of the wire 132L, 132R is connected to the steering wheel 134.

As mentioned above, the fourth embodiment is configured to have an underwater scooter 10 operable to enable a user to travel on a surface of water or underwater, comprising: a left elevator 104L disposed at left in a direction of forward motion of the scooter and swiveling around a lateral axis; and a right elevator 104R disposed at right in the direction of forward motion of the scooter and swiveling around the lateral axis; and wherein the left and right elevators swivel independently to make their swivel angles different up to vertical positions.

The underwater scooter further includes: a left manipulator (left grip 102L) connected to the left elevator 104L and changing a swivel angle of the left elevator in response to manipulation of the operator; a right manipulator (right grip 102R) connected to the right elevator 104R and changing the swivel angle of the right elevator in response to manipulation of the operator; a left locking mechanism 400L disposed at the left manipulator and locking the left elevator 104L to maintain the swivel angle of the left elevator; and a right locking mechanism 400R disposed at the right manipulator and locking the right elevator 104R to maintain the swivel angle of the right elevator.

As mentioned above, the second embodiment is configured to have an underwater scooter 10 operable to enable an operator to travel on a surface of water or underwater, comprising: a main frame 12 having a saddle area for supporting the operator thereon; a watertight vessel 14 disposed on the main frame toward a fore end thereof in a direction of forward motion of the scooter; a drive power unit (internal combustion engine E) enclosed within an interior of the watertight vessel; a driveshaft 202 passing through an interior of the main frame and being rotated by an output of the drive power unit; a propeller 16 disposed on the main frame toward an aft end thereof in the direction of forward motion of the scooter; a propeller shaft 204 connected to the propeller; an universal joint 200 transmitting an output of the drive shaft to the propeller shaft; and a propeller swivel mechanism 210 swiveling the propeller shaft 204 using the universal joint as a fulcrum, such that the propeller 16 swivels around a vertical axis.

The underwater scooter further includes: a depth adjusting mechanism 18 enabling to adjust a depth of travel of the scooter, and the propeller swivel mechanism 210 including: a swivel mechanism 108 enabling the depth adjusting mechanism 18 to swivel around a vertical axis; and a swivel angle displacement transmission mechanism (wire 212L, 212R) transmitting an angular displacement around the vertical axis of the depth adjusting mechanism 18 to a propeller shaft case 206 through which the propeller shaft 204 passes, such that the propeller shaft swivels around the vertical axis.

In the underwater scooter, the propeller swivel mechanism 210 comprises a foot stand 124 connected to the propeller shaft case 206 to be operable by the operator.

Japanese Patent Application Nos. 2004-116155, 2004-116157, 2004-116158 and 2004-116159, all filed on Apr. 9, 2004, are incorporated herein in their entirety.

While the invention has thus been shown and described with reference to specific embodiments, it should be noted that the invention is in no way limited to the details of the described arrangements; changes and modifications may be made without departing from the scope of the appended claims.

What is claimed is:

1. An underwater scooter operable to enable an operator, when seated thereon, to travel on a surface of water or underwater, said underwater scooter comprising:

a main frame having a saddle area for supporting an operator;

a watertight vessel disposed on the main frame toward a fore end thereof;

a drive power unit enclosed within an interior of the watertight vessel;

a propeller rotatably disposed on the main frame toward an aft end thereof;

a driveshaft passing through an interior of the main frame and adapted for transmitting an output of the drive power unit to the propeller so as to turn it;

a steering mechanism enabling the scooter to be steered; and a depth adjusting mechanism enabling the scooter to dive or surface.

2. The underwater scooter according to claim 1, wherein the steering mechanism is disposed below the watertight vessel, and the depth adjusting mechanism is disposed at each side of the watertight vessel.

3. The underwater scooter according to claim 1, wherein the steering mechanism and the depth adjusting mechanism are connected together as portions of a common unit.

4. The underwater scooter according to claim 1, wherein the depth adjusting mechanism comprises an elevator that is pivotally movable around a lateral axis with respect to the main frame, and the steering mechanism comprises a rudder disposed aftward of than the saddle area, that is pivotably movable around a vertical axis, and further including:

a swivel mechanism enabling the depth adjusting mechanism to pivot around a vertical axis relative to the main frame; and a swivel angle displacement transmission mechanism for transmitting an angular displacement around the vertical axis of the depth adjusting mechanism to the steering mechanism, such that the rudder is pivotable around the vertical axis.

5. The underwater scooter according to claim 4, wherein the swivel angle displacement transmission mechanism has one end that is connected to the depth adjusting mechanism and another end that comprises a wire connected to the steering mechanism.

6. The underwater scooter according to claim 5, wherein the swivel angle displacement transmission mechanism has a steering wheel that is connected to the rudder.

7. An underwater scooter operable to enable an operator, when seated thereon, to travel on a surface of water or underwater, said underwater scooter comprising:

a frame;

an elevator disposed on the frame and pivotally movable around a lateral axis;

a manipulator connected to the elevator and operable to change a swivel angle of the elevator in response to a manipulation by an operator; and a locking mechanism disposed adjacent the manipulator and capable of selectively locking the elevator to maintain the swivel angle of the elevator.

8. An underwater scooter operable to enable an operator, when seated thereon, to travel on a surface of water or underwater, said underwater scooter comprising:

for supporting an operator;

a watertight vessel disposed on the main frame toward a fore end thereof;

a drive power unit enclosed within an interior of the watertight vessel;

a driveshaft passing through an interior portion of the main frame and capable of being rotated by an output of the drive power unit;

a propeller rotatably disposed on the main frame toward an aft end of the scooter;

a propeller shaft connected to the propeller;

a universal joint for transmitting an output of the drive shaft to the propeller shaft; and a propeller swivel mechanism for pivotally moving the propeller shaft using the universal joint as a fulcrum, such that the propeller moves around a vertical axis.

9. The underwater scooter according to claim 8, further including:

a depth adjusting mechanism for enabling a user to adjust a depth of travel of the scooter, and wherein the propeller swivel mechanism comprises:

a swivel mechanism enabling the depth adjusting mechanism to move around a vertical axis; and a swivel angle displacement transmission mechanism for transmitting an angular displacement around the vertical axis of the depth adjusting mechanism to a propeller shalt case through which the propeller shaft passes, such that the propeller shaft swivels moves around the vertical axis.

10. The underwater scooter according to claim 9, wherein the propeller swivel mechanism comprises a foot stand connected to the propeller shaft case to be and operable by the operator.

* * * * *